US009222715B2

(12) United States Patent
Lee et al.

(10) Patent No.: US 9,222,715 B2
(45) Date of Patent: Dec. 29, 2015

(54) REFRIGERATOR AND CONTROL METHOD THEREOF

(75) Inventors: Taehee Lee, Seoul (KR); Sangbong Lee, Seoul (KR); Seokjun Yun, Seoul (KR); Younghoon Yun, Seoul (KR); Ilhyeon Jo, Seoul (KR)

(73) Assignee: LG Electronics Inc., Seoul (KR)

( * ) Notice: Subject to any disclaimer, the term of this patent is extended or adjusted under 35 U.S.C. 154(b) by 475 days.

(21) Appl. No.: 13/597,672

(22) Filed: Aug. 29, 2012

(65) Prior Publication Data

US 2013/0047652 A1 Feb. 28, 2013

(30) Foreign Application Priority Data

Aug. 30, 2011 (KR) ..... 10-2011-0086944
Aug. 30, 2011 (KR) ..... 10-2011-0086945
Aug. 30, 2011 (KR) ..... 10-2011-0086946

(51) Int. Cl.
*F25D 29/00* (2006.01)
*F25D 11/00* (2006.01)

(52) U.S. Cl.
CPC ..... *F25D 11/006* (2013.01); *F25D 29/00* (2013.01)

(58) Field of Classification Search
CPC ..... H04L 2012/285; F25B 2600/02; F25B 49/022; F25B 25/00; F25B 25/005–25/02; Y02B 30/54; F25D 11/006; F25D 11/025
USPC ..... 62/DIG. 22, 332, 333, 228.1; 307/126, 307/140, 26; 340/3.1, 870.16, 870.17
See application file for complete search history.

(56) References Cited

U.S. PATENT DOCUMENTS 5,553,457 A * 9/1996 Reznikov ..... 62/81
5,799,497 A * 9/1998 Sano et al. ..... 62/149
8,869,546 B2 * 10/2014 Besore et al. ..... 62/157
2006/0289553 A1 * 12/2006 Ehlers et al. ..... 221/9
2008/0174393 A1 * 7/2008 Schnetzka et al. ..... 336/57

(Continued)

FOREIGN PATENT DOCUMENTS

CN 1118058 A 3/1996
CN 1128316 C 11/2003

(Continued)

OTHER PUBLICATIONS

Chinese Office Action issued in application No. 201210315293.3 dated Jul. 3, 2014.

(Continued)

*Primary Examiner* — Mohammad M Ali
*Assistant Examiner* — Meraj A. Shaikh
(74) *Attorney, Agent, or Firm* — Ked & Associates, LLP

(57) ABSTRACT

A refrigerator is disclosed herein. The refrigerator may include a compressor to compress a refrigerant, a condenser to condense the refrigerant passed through the compressor, a capillary tube that lowers a temperature and pressure of the refrigerant passed through the condenser, an evaporator to evaporate the refrigerant passed through the capillary tube, a thermal storage device for auxiliary cooling that undergoes heat exchange with the refrigerant to store thermal energy, an energy management device that receives electric rate information, and a controller configured to control the compressor based on the electric rate information received at the energy management device. The controller may control an operation of the thermal storage device to provide auxiliary cooling for the refrigerator when the compressor is not operational or when electric rates are relatively high.

16 Claims, 28 Drawing Sheets

(56) References Cited

U.S. PATENT DOCUMENTS

| | | | | |
|---|---|---|---|---|
| 2009/0260371 | A1* | 10/2009 | Kuehl et al. | 62/79 |
| 2011/0011119 | A1* | 1/2011 | Kuehl et al. | 62/434 |
| 2011/0175742 | A1* | 7/2011 | Shin et al. | 340/635 |
| 2011/0259041 | A1* | 10/2011 | Kuehl et al. | 62/507 |
| 2012/0023987 | A1* | 2/2012 | Besore et al. | 62/157 |

FOREIGN PATENT DOCUMENTS

| | | | |
|---|---|---|---|
| CN | 1862196 | A | 11/2006 |
| CN | 101566382 | A | 10/2009 |
| CN | 201731710 | U | 2/2011 |
| DE | 19750053 | A1 | 5/1999 |
| GB | 2 201 499 | A | 9/1988 |
| JP | 2007-240048 | A | 9/2007 |
| KR | 10-2011-0085814 | A | 7/2011 |

OTHER PUBLICATIONS

European Search Report issued in Application No. 12181502.1 dated Jul. 20, 2015.

* cited by examiner

REFRIGERATOR AND CONTROL METHOD THEREOF

CROSS-REFERENCE TO RELATED APPLICATION(S)

This application claims the benefit of Korean Patent Application Nos. 10-2011-0086946; 10-2011-0086945 and 10-2011-0086944, filed in Korea on Aug. 30, 2011, which are hereby incorporated by reference as if fully set forth herein.

BACKGROUND

1. Field

A refrigerator and a method of controlling the same are disclosed herein.

2. Background

Refrigerators and methods of controlling the same are known. However, they suffer from various disadvantages.

BRIEF DESCRIPTION OF THE DRAWINGS

The embodiments will be described in detail with reference to the following drawings in which like reference numerals refer to like elements wherein.

DETAILED DESCRIPTION

Figure 1:
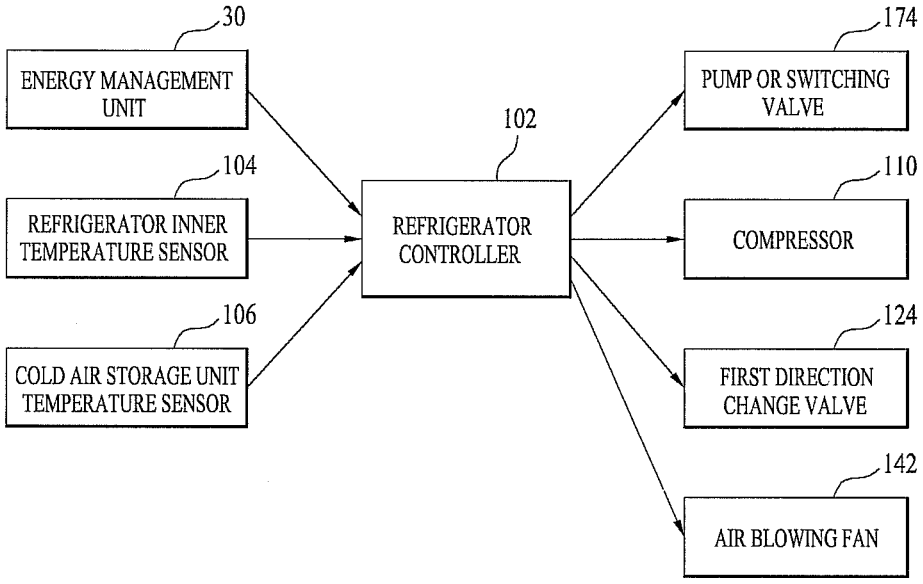
FIG. 1 is a block diagram of a refrigerator in accordance with one embodiment of the present disclosure.

In general, a refrigerator, which is used to store food, etc., in a frozen state or a refrigerated state, may include a case that forms an accommodation space divided into a freezing chamber and a refrigerating chamber, and devices that form a refrigerating cycle to lower the temperatures of the freezing chamber and the refrigerating chamber, such as compressors, condensers, evaporators, capillary tubes, etc.

In such a refrigerator, a cooling operation may be performed via the refrigerating cycle in which the compressor compresses a refrigerant in a low-temperature and low-pressure gaseous state into a high-temperature and high-pressure state, and the condenser condenses the compressed refrigerant in the high-temperature and high-pressure gaseous state into a high-temperature liquid state, the capillary tube lowers the temperature and pressure of the refrigerant in the high-pressure liquid state, and the evaporator changes the refrigerant to a low-temperature and low-pressure gaseous state while removing heat from the surroundings to cool surrounding air. With increased costs for power, e.g., electric rates, development of an active type refrigerator which may save electric charges is required.

Accordingly, the present disclosure is directed to a refrigerator and a control method thereof that substantially obviate one or more problems due to limitations and disadvantages of the related art.

An object of the present disclosure is to provide a refrigerator which reduces an electric power consumption quantity during a time when electric charges are high and is generally operated during a time when electric charges are low to reduce electric fees.

Another object of the present disclosure is to provide a refrigerator which stores thermal energy (e.g., cold air) using a thermal storage device (cold air storage unit) and supplies cold air using energy stored in the thermal storage device to a freezing chamber or a refrigerating chamber.

A further object of the present disclosure is to provide a refrigerator which effectively transmits cold air using energy stored in a thermal storage device to the inside of the refrigerator.

The present disclosure may be combined with smart grid technology. The smart grid technology may refer to a power network which optimizes energy efficiency by combining information technology (IT) with a power network so that a power supplier and a consumer may bidirectionally exchange information regarding power.

In the present disclosure, a power failure state in which power is not supplied from the outside to a refrigerator and a state in which electric charges are high may be recognized as the same state. Power is not supplied from the outside to the refrigerating during a power failure, and external power may not be used during a time when electric charges are high. That is, in both states, a thermosyphon may be operated without power supplied from the outside. Of course, in the case that electric charges are relatively low, a refrigerating cycle may be operated without operation of the thermosyphon.

A thermal storage device applied to the present disclosure may include a phase change material (PCM) therein. The phase change material refers to a material, the phase of which may be changed according to change in temperature so as to have latent heat.

When a thermal storage device accommodating a phase change material is installed on a refrigerator, a cold air storage method of storing cold air energy in the thermal storage device and a cold air emission method of emitting the cold air energy stored in the thermal storage device to the refrigerator must be considered.

The cold air storage method may be divided into a direct cooling type and an indirect cooling type, and the cold air emission method may also be divided into a direct cooling type and an indirect cooling type.

First, as the cold air storage method of storing cold air energy in the thermal storage device, there is the direct cooling type, e.g., a method in which a phase change material is installed on a pipe through which a refrigerant flows. In this case, heat exchange between the pipe through which the refrigerant flows and the phase change material is carried out by conduction.

Further, as the cold air storage method of storing cold air energy in the thermal storage device, there is the indirect cooling type, e.g., a method in which air is used as a medium when an evaporator (evaporation unit) and a phase change material exchanges heat. In this case, heat exchange between the evaporator and the phase change material is carried out by convection.

The cold air emission method of emitting the cold air energy stored in the thermal storage device may be divided into the direct cooling type in which the inside of the refrigerator is cooled by natural convection using a heat exchanger installed in the refrigerator without generation of forced convention using a fan in a similar manner to a direct cooling type refrigerator, and the indirect cooling type in which forced convection is generated using a fan.

In case of the direct cooling type cold air emission method, natural convection may be used, and thus, the phase change material may be located at the upper part of the refrigerator to be cooled so as to properly cool the inside of the refrigerator. When the phase change material is located at the upper part of the refrigerator, cold air supplied from the phase change material may be easily flow to the lower part of the refrigerator.

On the other hand, in case of the indirect cooling type of the cold air emission method, there is no restriction as to the installed position of the thermal storage device, but a certain amount of power is required to drive an air blowing fan to generate forced convection. For reference, the indirect cooling type may uniformly maintain the temperature of the refrigerator due to generation of convection within the chamber from the air blowing fan, and may have excellent cooling performance within the refrigerator due to improved heat exchange efficiency with the phase change material.

Further, there are an direct type and an indirect type divided according to whether or not a heat exchanger is used to improve heat exchange efficiency of the thermal storage device. The direct type may include a type in which heat exchange is carried out on the surface of a phase change material or the surface of a case accommodating the phase change material, and the indirect type may include a type in which heat exchange is carried out by a separately used heat exchanger.

FIG. 1 is a block diagram of a refrigerator in accordance with one embodiment of the present disclosure. An energy management device 30 may transmit information regarding power supply time at which electric charges are varied (or power rate information during peak usage periods) to a refrigerator controller 102. That is, the energy management device 30 may transmit information regarding whether or not electric charges at the current time are higher or lower than electric charges at other times to the refrigerant controller 102.

Further, a refrigerator inner temperature sensor 104 may sense an inner temperature of the refrigerator and a thermal storage device temperature sensor 106 may sense a temperature of a thermal storage device, and the refrigerator inner temperature sensor 104 and the thermal storage device temperature sensor 106 transmit the sensed temperatures to the refrigerator controller 102. The refrigerator inner temperature sensor 104 may be exposed to the inside of the refrigerator to measure the inner temperature of the refrigerator, and the thermal storage device temperature sensor 106 may contact the thermal storage device to measure the temperature of the thermal storage device.

The refrigerator controller 102 may operate the refrigerator in an electric charge saving manner according to information transmitted from the energy management device 30, whether or not a user sets an electric charge saving mode and whether or not electric charges of the current time are relatively low.

The refrigerator controller 102 may turn an air blowing fan 142 generating an air flow on/off, and may operate a compressor 110 constituting a refrigerating cycle. Further, the refrigerator controller 102 may control a path of a refrigerant using a first direction change valve 124. Although this will be described later, the first direction change valve 124 may change the path through which a first refrigerant passes to a position A or a position B.

The air blowing fan 142 may be installed adjacent to an evaporator or a heat exchanger which will be described later. The air blowing fan 142 generates convection so that cold air transmitted from the thermal storage device by a second refrigerant may be transmitted to the inside of the refrigerator by the evaporator or the heat exchanger.

Further, the refrigerator controller 102 may control a pump or a switching valve 174 according to power information transmitted from the energy management device 30. Here, the power information may be information regarding electric power supply time or electric rate information at which electric charges are varied. That is, the refrigerator controller 102 may operate the pump or stop operation of the pump, and may control opening and closing of the path using the switching valve 174.

Figure 2:
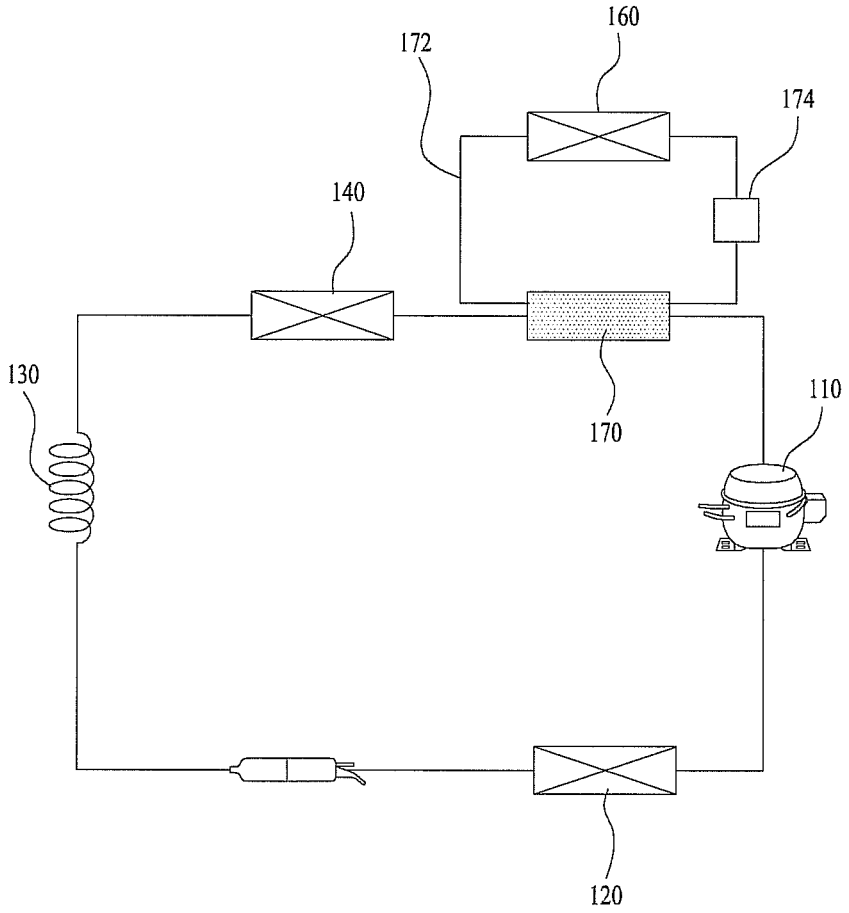
FIG. 2 is a circuit diagram illustrating a configuration of the refrigerator in accordance with one embodiment of the present disclosure.

FIG. 2 is a circuit diagram illustrating a configuration of the refrigerator in accordance with one embodiment of. The refrigerator may include a compressor 110, a condenser 120, a capillary tube 130 and an evaporation unit 140 (evaporator) which basically form the refrigerating cycle, and the refrigerating cycle using the first refrigerant is formed through these components. The compressor 110 compresses the first refrigerant circulating through the refrigerating cycle, the condenser 120 condenses the first refrigerant having passed through the compressor 110, the capillary tube 130 lowers the temperature and pressure of the first refrigerant having passed through the condenser 120, and the evaporation unit 140 evaporates the first refrigerant having passed through the capillary tube 130.

In the embodiment of FIG. 2, a thermal storage device 170 may be disposed at the rear end of the evaporator 140. Here, the rear end of the evaporator 140 is set based on a moving direction of the first refrigerant circulating through the refrigerating cycle, and refers to the position to which the first refrigerant moves after passing through the evaporator 140. For example, the first refrigerant moves to the thermal storage device 170 after passing through the evaporator 140.

The thermal storage device 170 may be installed in a space between an outer case and an inner case of the refrigerator, or may be installed in the inner case to be exposed directly to food, etc., stored in the refrigerator.

With reference to FIG. 2, when the first refrigerant having passed through the compressor 110, the condenser 120, the capillary tube 130 and the evaporator 140 contacts the thermal storage device 170 or the case of the thermal storage device 170, the first refrigerant directly cools the thermal storage device 170. The thermal storage device 170 may be cooled by undergoing heat exchange with the first refrigerant circulating along the refrigerating cycle through conduction. Since the thermal storage device 170 may be cooled by conduction in which energy is transmitted by contact, cold air energy of the first refrigerant may be effectively transmitted to the thermal storage device 170.

Here, in order to increase a surface or contact area where heat exchange between the thermal storage device 170 and a pipe of the refrigerant circulating through the refrigerating cycle occurs, the refrigerant pipe may be bent in a Z shape or a serpentine shape to increase the volume thereof, or a separate member to increase a contact area, such as a fin, may be installed at the outer surface of the refrigerant pipe.

The refrigerator may include a heat exchanger 160 connected to the thermal storage device 170 through a guide pipe 172. The guide pipe 172 may connect the thermal storage device 170 and the heat exchanger 160 so as to circulate the second refrigerant between the thermal storage device 170 and the heat exchanger 160. A refrigerant differing from the first refrigerant implementing the above-described basic refrigerating cycle may be used as the second refrigerant, and the first refrigerant and the second refrigerant may be independently circulated. That is, the first refrigerant and the second refrigerant may be circulated through respective paths without mixing.

The heat exchanger 160 may be exposed to the inner space of a refrigerating chamber or a freezing chamber of the refrigerator. When cold air energy stored in the thermal storage device 170 is used, a factor which most highly influences lowering of the inner temperature of the refrigerator may be a heat exchange area of the thermal storage device 170. In general, the thermal storage device 170 is kept within a case or enclosure manufactured by injection molding, and heat exchange of the thermal storage device 170 within the refrigerator is carried out through the case surrounding the thermal storage device 170. Therefore, given a particular size of a thermal storage device 170, the case or enclosure of the thermal storage device 170 may adversely affect the cooling performance (the lowering of inner temperature of the refrigerator). Therefore, in order to improve cold air transmission efficiency, the separate heat exchanger 160 may be provided.

Circulation of the second refrigerant between the heat exchanger 160 and the thermal storage device 170 may be carried out by a thermosyphon or through brine circulation. First, the thermosyphon not requiring additional electric power supply may be used when the second refrigerant is circulated between the thermal storage device 170 and the heat exchanger 160. The thermosyphon refers to a syphon action generated by a thermal imbalance, such as self-evaporation, a temperature difference, etc. In this case, reference numeral 174 refers to a switching valve that adjusts whether or not the second refrigerant is allowed to flow in the thermosyphon between the thermal storage device 170 and the heat exchanger 160.

If the refrigerator controller 102 opens the guide pipe 172 using the switching valve 174, the second refrigerant may circulate between the thermal storage device 170 and the heat exchanger 160 by the thermosyphon. On the other hand, if the switching valve 174 closes the guide pipe 172, circulation of the second refrigerant between the thermal storage device 170 and the heat exchanger 160 is stopped.

In one embodiment, brine circulation may be used between the thermal storage device 170 and the heat exchanger 160. Here, the second refrigerant is brine, and a pump 174 circulating the second refrigerant may be provided on the guide pipe 172. Brine may include seawater, a saline solution, a salt solution for freezing such as calcium chloride or magnesium chloride, a salt solution for bleaching such as a sulfur solution, or another appropriate type of solution. In brine circulation, brine may be accommodated in the guide pipe 172, and circulation of the brine may be performed between the thermal storage device 170 and the heat exchanger 160 through the guide pipe 172 according to whether or not the pump 174 is operated, thereby allowing cold air of the thermal storage device 170 to be transmitted to the heat exchanger 160.

As shown in FIG. 2, when the compressor 110 is operated and the first refrigerant is circulated along the refrigerating cycle, cold air may be stored in the thermal storage device 170 by conduction. Then, cold air of the evaporator 140 lowers the inner temperature of the refrigerator, thus being capable of effectively operating the refrigerator. Here, the switching valve 174 may be closed or operation of the pump 174 may be stopped so that the second refrigerant is not circulated through the guide pipe 172.

On the other hand, during a time when electric charges are high, the refrigerating cycle using the first refrigerant may be stopped and the second refrigerant may be circulated. At this time, if thermosyphon circulation through the guide pipe 172 is performed, the switching valve 174 is opened. On the other hand, if brine circulation through the guide pipe 172 is performed, the pump 174 is operated to circulate the second refrigerant. Further, convection may be generated by operating the air blowing fan 142 so that cold air of the heat exchanger 160 is effectively transmitted to the inside of the refrigerator.

Figure 3:
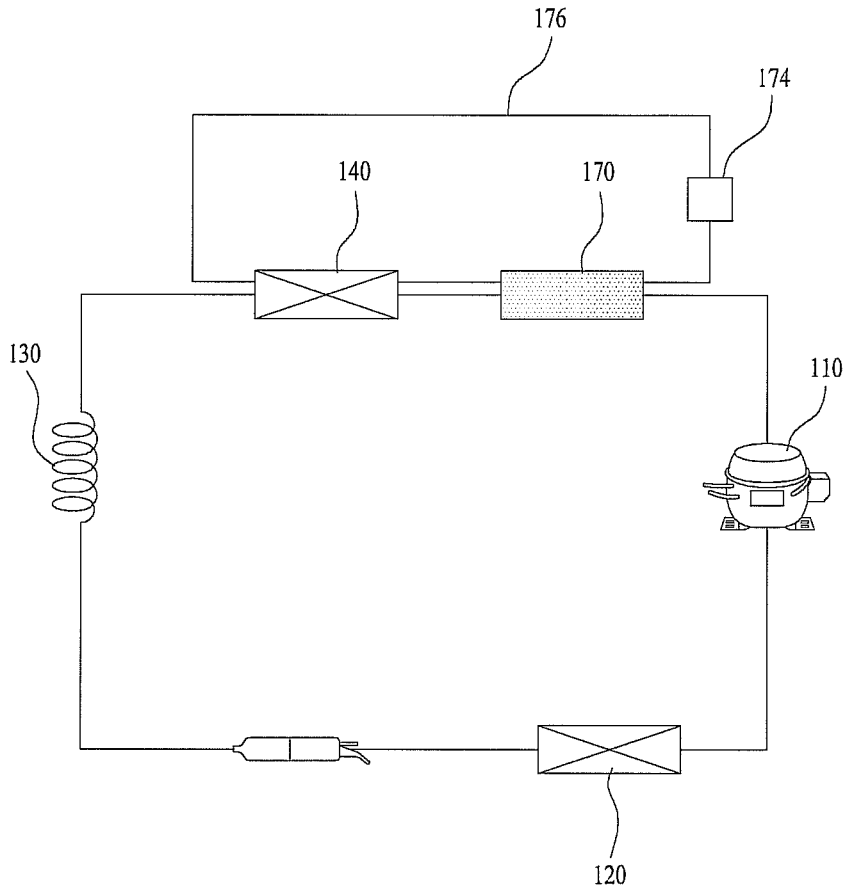
FIG. 3 is a circuit diagram illustrating a configuration of a refrigerator in accordance with one embodiment of the present disclosure.
Figure 5:
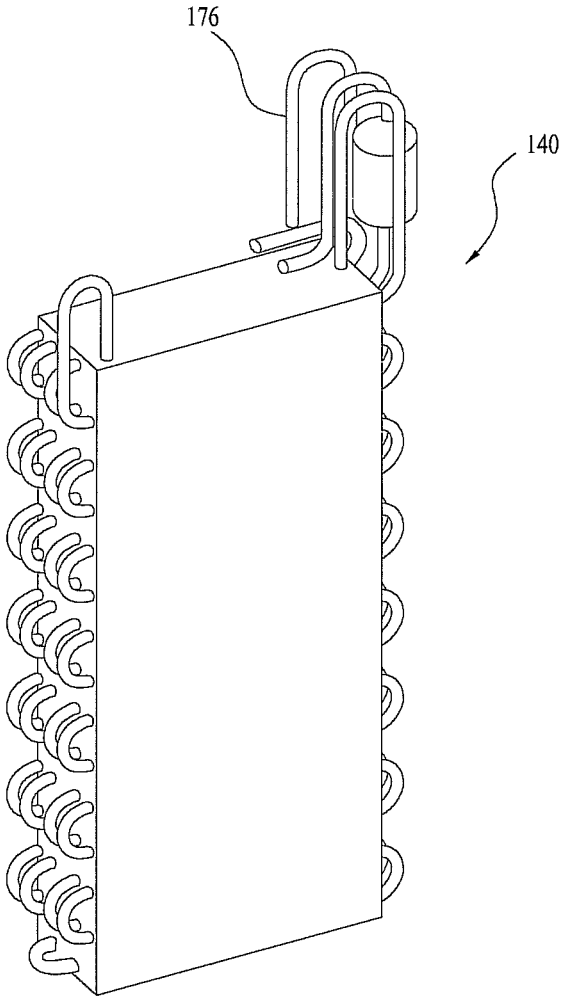
FIG. 5 is a perspective view of a portion of an evaporator.

FIG. 3 is a circuit diagram illustrating a configuration of a refrigerator in accordance with one modification of the embodiment of FIG. 2. In this embodiment, a separate heat exchanger is not provided and the evaporator 140 may perform a function of transmitting cold air transmitted from the thermal storage device 170. Here, the evaporator 140 may have a shape as shown in FIG. 5 which will be described later.

In this embodiment, an induction pipe 176 through which a second refrigerant differing from a first refrigerant having passed through the compressor 110 may be independently moved and circulated may be provided between the thermal storage device 170 and the evaporator 140. Particularly, the first refrigerant and the second refrigerant are not mixed, but may be independently circulated regardless of circulation of the counterpart.

Circulation of the refrigerant between the evaporator 140 and the thermal storage device 170 through the induction pipe 176 may be carried out by a thermosyphon or through brine circulation. The configuration of the thermosyphon or brine circulation in accordance with the of FIG. 2 may be applied to the modification of the embodiment of FIG. 3. However, the guide pipe is used in the embodiment of FIG. 2 and the induction pipe 176 is used in the present embodiment.

For reference, reference numeral 174 may refer to a switching valve if circulation by the thermosyphon is carried, and means a pump if brine circulation is carried out.

Figure 4:
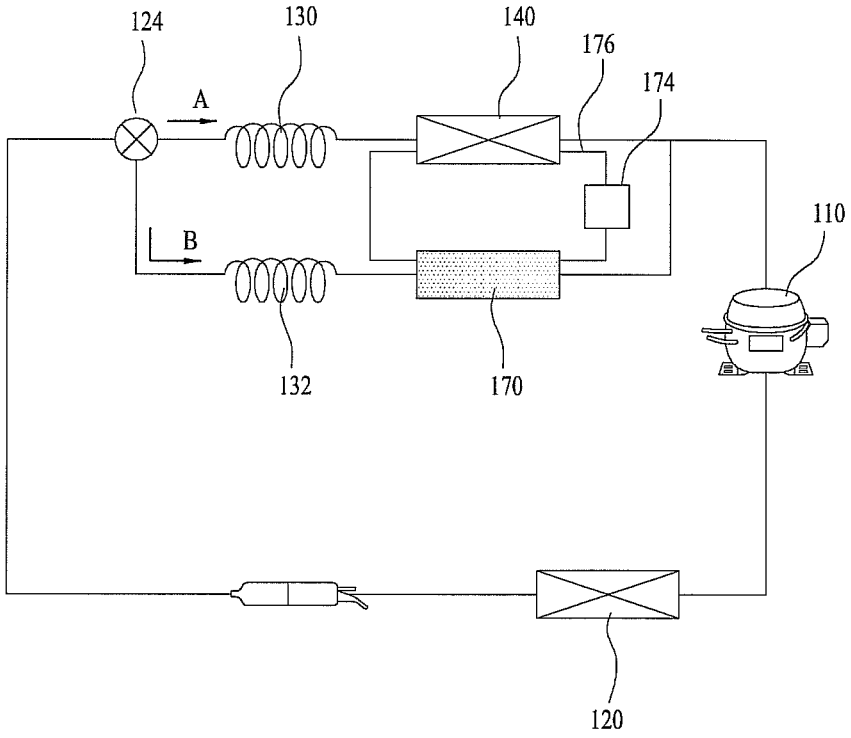
FIG. 4 is a circuit diagram illustrating a configuration of a refrigerator in accordance with another embodiment of the present disclosure.

FIG. 4 is a circuit diagram illustrating a configuration of a refrigerator in accordance with another modification of the embodiment of FIG. 2. The refrigerant in accordance with the embodiment shown in FIG. 4 may include a first direction change valve 124 branching the first refrigerant having passed through the condenser 120, and a sub-capillary tube 132 installed at the rear of the first direction change valve 124, e.g., coupled to the outlet port of the valve 124. Here, the thermal storage device 170 may be disposed at the rear end of the sub-capillary tube 132, e.g., at the outlet of the sub-capillary tube 132.

Based on the direction of the refrigerating cycle, the capillary tube 130 and the evaporator 140 are disposed in parallel with the sub-capillary tube 132 and the thermal storage device 170. The first refrigerant having passed through the capillary tube 130 and the evaporator 140 and the first refrigerant having passed through the sub-capillary tube 132 and the thermal storage device 170 may be collected at the rear of the evaporator 140 and the thermal storage device 170.

With reference to FIG. 4, the first refrigerant circulating through the refrigerating cycle may flow along one selected from the capillary tube 130 and the sub-capillary tube 132 by the first direction change valve 124. If the capillary tube 130 is selected as the path of the first refrigerant (the position A), the first refrigerant flows to the evaporator 140, and thus, the inside of the refrigerator may be cooled.

On the other hand, if the sub-capillary tube 132 is selected as the path of the first refrigerant (the position B), the first refrigerant flows to the thermal storage device 170, and thus, the thermal storage device 170 may be cooled and cold air energy may be stored in the thermal storage device 170. Of course, if the thermal storage device 170 is located within the refrigerator, the inside of the refrigerator may be cooled together with cooling of the thermal storage device 170. However, cooling efficiency in the case that the refrigerant moves to the thermal storage device 170 may be lower than cooling efficiency in the case that the refrigerant moves to the evaporator 140.

If the main objective is to lower the inner temperature of the refrigerator, the first direction change valve 124 may move the first refrigerant to the evaporator 140, and if the inner temperature of the refrigerator is sufficiently lowered and it is necessary to store cold air within the thermal storage device 170, the first direction change valve 124 may move the first refrigerant to the thermal storage device 170.

The first refrigerant having passed through the thermal storage device 170 may be mixed with the first refrigerant having passed through the evaporator 140 or may be individually transmitted, and may then be guided to the compressor 110, thereby constituting the general refrigerating cycle. That is, although the capillary tube 130 or the sub-capillary tube 132 is selected as the path of the first refrigerant through the first direction change valve 124, all the first refrigerant moves to the compressor 110.

Further, an induction pipe 176 through which a second refrigerant differing from the first refrigerant having passed through the compressor 110 independently moves and is circulated is provided between the thermal storage device 170 and the evaporator 140. The modification of the embodiment shown in FIG. 3 and the modification of the embodiment shown in FIG. 4 are the same in that a separate heat exchanger to use the cold air of the thermal storage device 170 is not provided and the evaporator 140 performs two functions.

Further, circulation of the refrigerant between the evaporator 140 and the thermal storage device 170 through the induction pipe 176 may be carried out by a thermosyphon or through brine circulation. The configuration of the thermosyphon or brine circulation in accordance with the embodiment shown in FIG. 2 may be applied to the modification of the embodiment shown in FIG. 4. However, the modification of the embodiment shown in FIG. 4 differs from the embodiment in that the guide pipe is used in the first embodiment and the induction pipe 176 is used in the modification of the first embodiment shown in FIG. 4.

For reference, reference numeral 174 may be a switching valve if circulation by the thermosyphon is carried, and may be a pump if brine circulation is carried out.

FIG. 5 is a perspective view of a portion of an evaporator. The evaporator shown in FIG. 5 is a component of the evaporator 140. Such an evaporator may include two pipes through which two different refrigerants independently move without mixing, at the upper end thereof. One of the two pipes may be the induction pipe 176 shown in FIG. 3 or 4, and the other of the two pipes may be a moving path of the first refrigerant passing through the compressor 110 and the condenser 120. The induction pipe 176 and the moving path of the first refrigerant do not cross each other, and may be independently provided.

That is, in accordance with the embodiment shown in FIG. 5, the two different refrigerants may achieve heat exchange while moving through two different moving paths in one evaporator, and thus, the refrigerant circulation path shown in FIG. 3 or 4 may be implemented.

Figure 6:
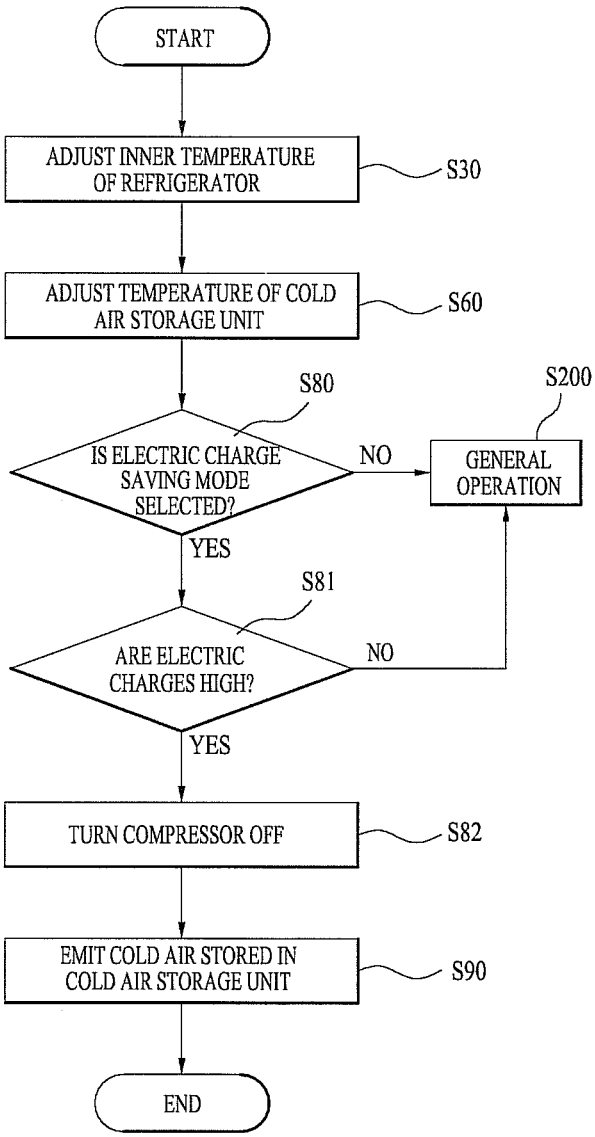
FIG. 6 is a flowchart illustrating a control process of a refrigerator in accordance with one embodiment of the present disclosure.

FIG. 6 is a flowchart illustrating a control process of the refrigerator in accordance with one embodiment of the present disclosure. Hereinafter, the overall control process of the refrigerator in accordance with the first embodiment will be described with reference to FIG. 6.

First, the inner temperature of the refrigerator may be adjusted, in step S30. Since food is stored within the refrigerator, the compressor 110, etc. are operated to sufficiently lower the inner temperature of the refrigerator. Thereafter, the temperature of the thermal storage device 170 may be adjusted, in step S60. The thermal storage device 170 may store cold air energy generated by the compressor 110, etc. Whether or not the electric charge saving mode is set, e.g., by a user, may be judged, in step S80.

Upon judging that the electric charge saving mode is not been set, it is judged that it is not necessary to save electric charges and general operation is performed, in step S200. During general operation, a process of cooling the inside of the refrigerator by the general refrigerating cycle or a process of storing cold air within the thermal storage device 170 may be performed. That is, general operation refers to a state in which the refrigerator is generally or normally operated regardless of whether or not electric charges are high. Such general operation may have the same meaning as the above-described operation in an original set state.

During general operation, circulation of the second refrigerant may be restricted. For this purpose, movement of the second refrigerant may be restricted by closing the path using the switching valve 174 or stopping operation of the pump 174.

Upon judging that the electric charge saving mode is set by the user, whether or not electric charges are high is judged, in step S81. Whether or not electric charges are high may be judged using information transmitted from the energy management device 30. That is, if a power supply time corresponds to a first time section, it may be judged that electric charges are relatively high, and if the power supply time corresponds to a second time section, it may be judged that electric charges are relatively low. Levels of electric charges may be measured based on prescribed levels, for example, a relatively high electric rates may be when electric rates are above a first prescribed amount, and a relatively low electric rates may be when electric rates are below a second prescribed amount. The prescribed amounts or limits may be set by the user or default values may be provided.

Upon judging that electric charges are high, operation of the compressor 110 may be first stopped, in step S82. The reason for this is that, if the compressor 110 is operated when electric charges are high, a relatively high electric fee may be generated. On the other hand, upon judging that electric charges are low, general operation is performed, in step S200. Thereafter, cold air stored in the thermal storage device 170 may be emitted to the inside of the refrigerator to cool the inside of the refrigerator, in step S90.

However, upon judging that the power supply time corresponds to the second time section and thus electric charges are relatively low although the electric charge saving mode is set, the above-described general operation may be performed, in step S200.

Figure 7:
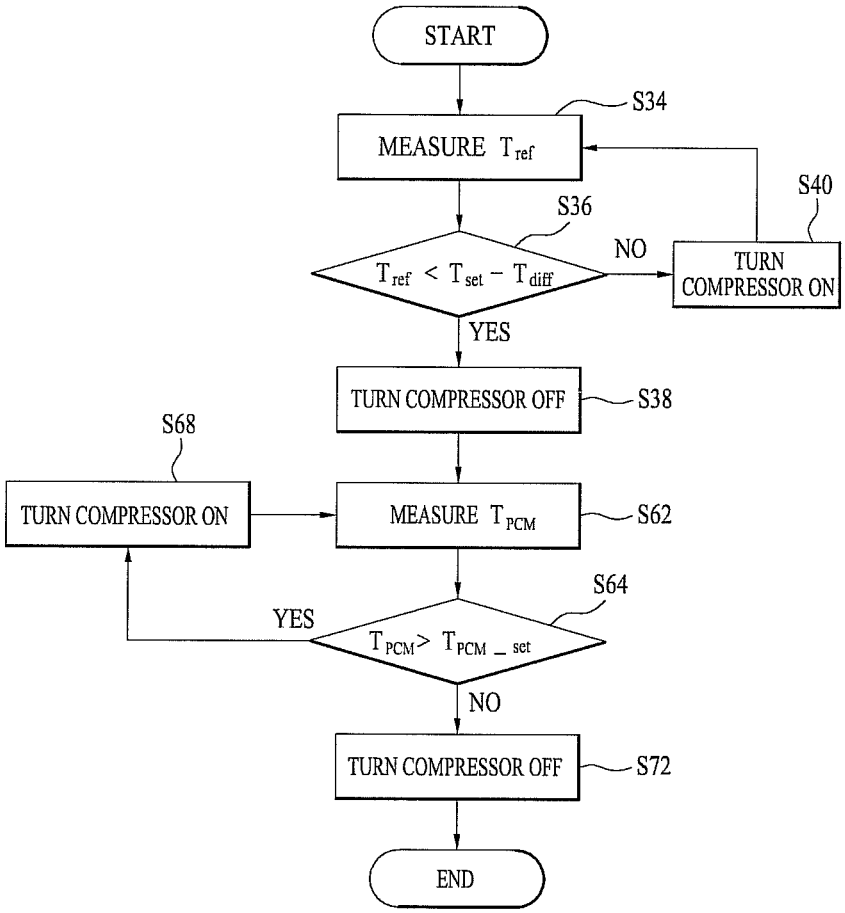
FIG. 7 is a flowchart illustrating a control process of a refrigerator in accordance with the embodiment of FIG. 6.

FIG. 7 is a flowchart illustrating a detailed control process of refrigerator inside cooling and cold air storage in the refrigerators in accordance with the embodiment of FIG. 2 and the modification thereof of FIG. 3. Hereinafter, the detailed control process of refrigerator inside cooling and cold air storage will be described with reference to FIG. 7.

An inner temperature $T_{ref}$ of the refrigerator may be measured by the refrigerator inner temperature sensor 104, in step S34. Thereafter, whether or not the measured inner temperature $T_{ref}$ of the refrigerator is lower than an allowable range limit value $T_{set}+T_{diff}$ of a set inner temperature of the refrigerator is judged, in step S36.

Thereafter, upon judging that the measured inner temperature $T_{ref}$ of the refrigerator is not lower than the allowable range limit value ($T_{set}+T_{diff}$), it is judged that it is necessary to cool the inside of the refrigerator, and thus, the compressor 110 may be operated to cool the inside of the refrigerator, in step S40.

On the other hand, upon judging that the measured inner temperature $T_{ref}$ of the refrigerator is lower than the allowable range limit value ($T_{set}+T_{diff}$), operation of the compressor 110 may be stopped, in step S38. The reason for this is that, if the measured inner temperature $T_{ref}$ of the refrigerator is lower than the allowable range limit value ($T_{set}+T_{diff}$), it is judged that it is not necessary to cool the inside of the refrigerator any longer. Under the condition that operation of the compressor 110 is stopped in an initial stage, step S38 may be omitted.

Thereafter, a temperature TPCM of the thermal storage device 170 may be measured by the thermal storage device temperature sensor 106, in step S62. If the temperature $T_{PCM}$ of the thermal storage device 170 is higher than a thermal storage device set temperature $T_{PCM_set}$, it is judged that it is necessary to store cold air within the thermal storage device 170, in step S64. Then, the compressor 110 is operated to store cold air within the thermal storage device 170, in step S68.

On the other hand, if the temperature TPCM of the thermal storage device 170 is not higher than the thermal storage device set temperature $T_{PCM_set}$, operation of the compressor 110 is stopped, in step S72. Further, S72 may also be omitted under the condition that the compressor 110 is not operated.

Figure 8:
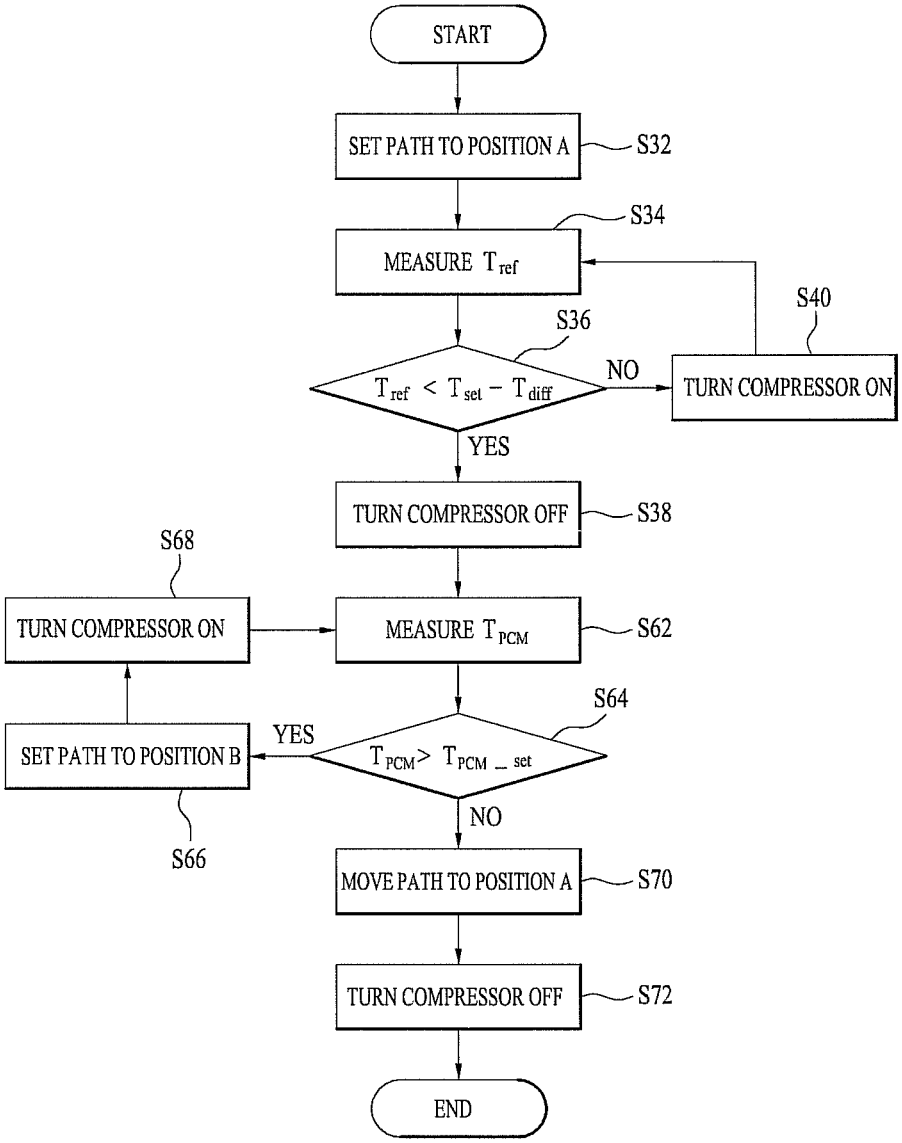
FIG. 8 is a flowchart illustrating a control process of a refrigerator in accordance with the embodiment of FIG. 6.

FIG. 8 is a flowchart illustrating a detailed control process of refrigerator inside cooling and cold air storage in the refrigerator in accordance with the modification of the embodiment of FIG. 2 as illustrated in FIG. 4. Hereinafter, the detailed control process of refrigerator inside cooling and cold air storage will be described with reference to FIG. 8.

First, the path of the first direction change valve 124 is set to the position A, in step S32. The position A means a state in which cold air is not stored in the thermal storage device 170. Thereafter, an inner temperature $T_{ref}$ of the refrigerator is measured by the refrigerator inner temperature sensor 104, in step S34. Thereafter, whether or not the measured inner temperature $T_{ref}$ of the refrigerator is lower than an allowable range limit value $T_{set}+T_{diff}$ of a set inner temperature of the refrigerator is judged, in step S36.

Thereafter, upon judging that the measured inner temperature $T_{ref}$ of the refrigerator is not lower than the allowable range limit value ($T_{set}+T_{diff}$), it is judged that it is necessary to cool the inside of the refrigerator and thus the compressor 110 is operated to cool the inside of the refrigerator, in step S40.

On the other hand, upon judging that the measured inner temperature $T_{ref}$ of the refrigerator is lower than the allowable range limit value ($T_{set}+T_{diff}$), operation of the compressor 110 is stopped, in step S38. The reason for this is that, if the measured inner temperature $T_{ref}$ of the refrigerator is lower than the allowable range limit value limit value ($T_{set}+T_{diff}$), it is judged that it is not necessary to cool the inside of the refrigerator any longer. Under the condition that operation of the compressor 110 is stopped in an initial stage, S38 may be omitted.

Thereafter, a temperature TPCM of the thermal storage device 170 is measured by the thermal storage device temperature sensor 106, in step S62. If the temperature $T_{PCM}$ of the thermal storage device 170 is higher than a thermal storage device set temperature $T_{PCM\text{-}set}$, it is judged that it is necessary to store cold air within the thermal storage device 170, and the first direction change valve 124 is controlled so that the refrigerant flows to the position B, in step S66. When the refrigerant flows to the position B, a larger amount of cold air than in the position A may be stored in the thermal storage device 170, or all of the cold air generated from the compressor 110 may be stored in the thermal storage device 10. Then, the compressor 110 is operated to store cold air within the thermal storage device 170, in step S68.

On the other hand, if the temperature $T_{PCM}$ of the thermal storage device 170 is not higher than the thermal storage device set temperature TPCM-set, the first direction change valve 124 is controlled so that the refrigerant flows to the position A, in step S70. Here, S70 may be omitted if the first direction change valve 124 is set in advance such that the refrigerant flows to the position A. Thereafter, operation of the compressor 110 is stopped, in step S72. Further, S72 may also be omitted under the condition that the compressor 110 is not operated.

Figure 9:
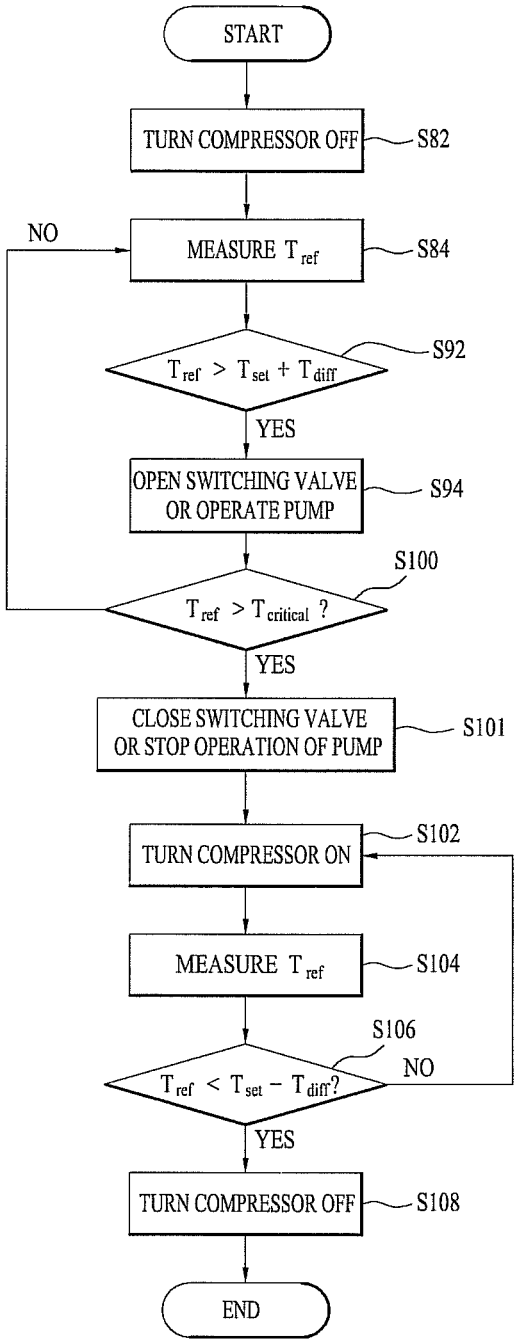
FIG. 9 is a flowchart illustrating a control process of cold air emission in the refrigerator of FIG. 6.

FIG. 9 is a flowchart illustrating the detailed control process of cold air emission in the refrigerator of FIG. 6. FIG. 9 is a flowchart if an electric charge saving mode is set by a user and a power supply time corresponds to the first time section. If the power supply time corresponds to the second time section although the electric charge saving mode is set by the user, the control process of FIG. 9 is not performed.

The control process of cold air emission in the refrigerator of FIG. 9 may be applied in common to the above-described first embodiment, the former modification thereof and the latter modification thereof. Hereinafter, the control process of cold air emission will be described with reference to FIG. 9.

First, operation of the compressor 110 is stopped, in step S82. The reason for this is that, if the compressor 110 is operated when electric charges are relatively high, high an electric fee is generated.

Since operation of the compressor 110 is stopped, the inner temperature of the refrigerator is gradually raised. When the inner temperature of the refrigerator reaches a designated temperature, cold air stored in the thermal storage device 170 is supplied to the inside of the refrigerator, and may thus lower the inner temperature of the refrigerator.

Thereafter, an inner temperature $T_{ref}$ of the refrigerator is measured by the refrigerator inner temperature sensor 104, in step S84. Thereafter, whether or not the measured inner temperature $T_{ref}$ of the refrigerator is higher than a limit value $T_{set}+T_{diff}$ of a set inner temperature of the refrigerator is judged, in step S92. If the measured inner temperature $T_{ref}$ of the refrigerator is higher than the limit value $T_{set}+T_{diff}$, it may be judged that it is necessary to cool the inside of the refrigerator.

Upon judging that the measured inner temperature $T_{ref}$ of the refrigerator is higher than the limit value $T_{set}+T_{diff}$, cold air stored in the thermal storage device 170 is emitted. At this time, if the thermosyphon is used, the switching valve 174 is opened. On the other hand, if brine circulation is used, the pump 174 is operated to circulate the second refrigerant, in step S94. Further, the air blowing fan 142 may be operated to transmit cold air of the heat exchanger 160 or the evaporator 140 to the inside of the refrigerator through convection.

Thereafter, whether or not the inner temperature $T_{ref}$ of the refrigerator measured by the refrigerant inner temperature sensor 104 is higher than a critical temperature $T_{critical}$ is judged, in step S100. If the measured inner temperature $T_{ref}$ of the refrigerator is higher than the critical temperature $T_{critical}$, it is judged that the inside of the refrigerator is not sufficiently cooled by the cold air supplied from the thermal storage device 170. Therefore, circulation of the second refrigerant is stopped. At this time, if the thermosyphon is used, the path of the second refrigerant is closed by the switching valve 174, and if brine circulation is used, operation of the pump 174 is stopped, in step S101. Thereafter, the compressor 110 is operated so as to perform the refrigerating cycle using the first refrigerant, in step S102.

Thereafter, the inner temperature $T_{ref}$ of the refrigerator is continuously measured, in step S106, and if the measured inner temperature $T_{ref}$ of the refrigerator is lower than an allowable range limit value $T_{set}-T_{diff}$ of a set inner temperature of the refrigerator, operation of the compressor 110 is stopped, in step S108. The reason for this is that it is judged that the inner temperature $T_{ref}$ of the refrigerator is sufficiently lowered and the inside of the refrigerator is sufficiently cooled.

Figure 10:
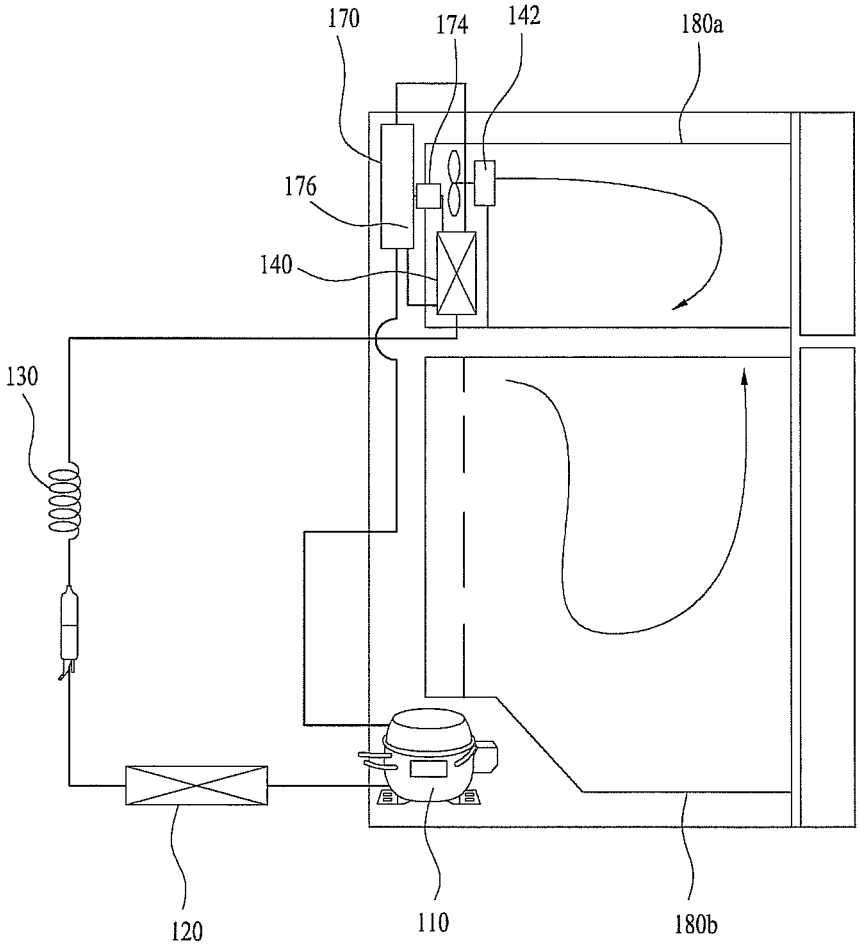
FIG. 10 is a schematic view illustrating an implemented state of the refrigerator in accordance with the embodiment of FIG. 1.

FIG. 10 is a schematic view illustrating an implemented state of the refrigerator in accordance with the former modification as illustrated in FIG. 3 of the embodiment of FIG. 2. Hereinafter, the refrigerator in accordance with the former modification of the first embodiment will be described with reference to FIGS. 3 and 10.

The first refrigerant circulating the compressor 110, the condenser 120, the capillary tube 130 and the evaporator 140 stores cold air within the thermal storage device 170. Here, since the thermal storage device 170 directly contacts a refrigerant pipe forming the refrigerating cycle, cold air may be stored in the thermal storage device 170 by conduction.

In the configuration of FIG. 10, the induction pipe 176 connecting the thermal storage device 170 and the evaporator 140 and the switching valve 174 controlling the flow of the refrigerant along the induction pipe 176 are provided, using the evaporator having the shape shown in FIG. 5 without a separate heat exchanger. The evaporator 140 and the thermal storage device 170 may perform circulation of the second refrigerant through the induction pipe 176 by the thermosyphon or through brine circulation.

The compressor 110 may be installed in a machinery chamber located at the lower portion of the refrigerator, and the evaporator 140 and the thermal storage device 170 may be disposed at the upper portion of the refrigerator. This modification of the embodiment of FIG. 2 is not limited to FIG. 10, but may be variously modified.

In the modification shown in FIG. 10, the cold air formed by the basic refrigerating cycle may be provided by the evaporator 140, and be supplied to the inside of a freezing chamber 180*a* by the air blowing fan 142. The cold air supplied from the evaporator 140 may also cool the thermal storage device 170, thereby simultaneously achieving general operation and cold air storage operation.

Figure 11:
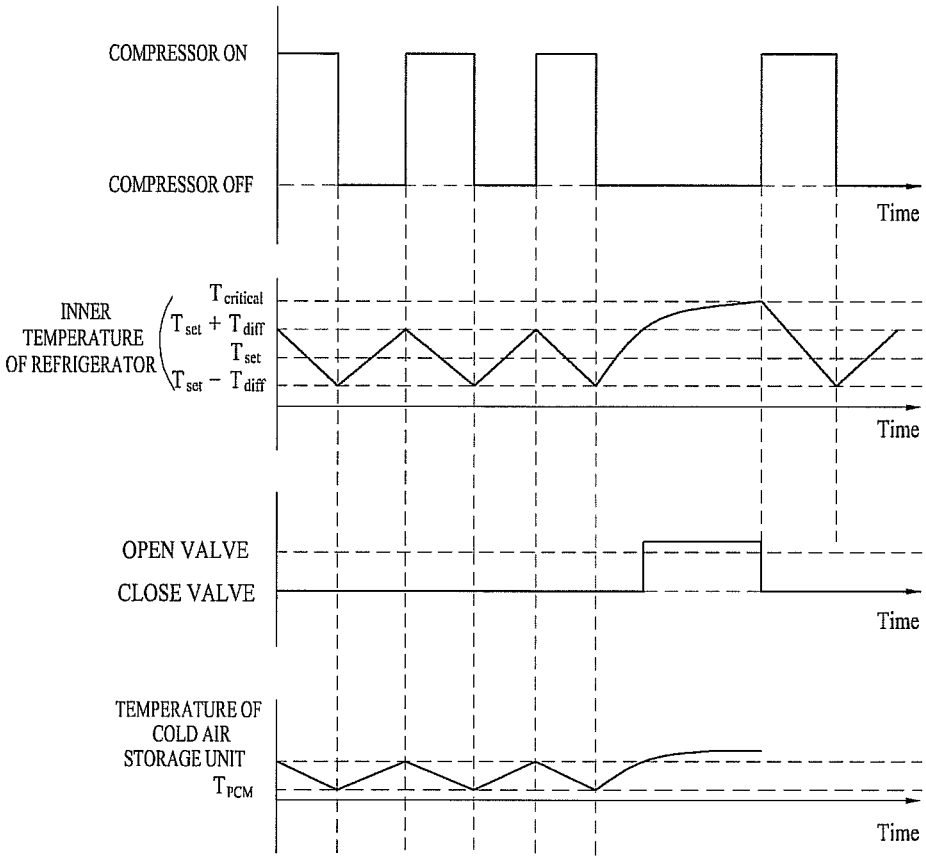
FIG. 11 is a graph illustrating an operation of components of a refrigerator based on time.

FIG. 11 is a graph illustrating an operation of the components of the refrigerators based on time in accordance with the embodiment of FIG. 10. Hereinafter, operation of the components of the refrigerators based on time in accordance with the first embodiment and the former modification thereof will be described with reference to FIG. 11.

The inner temperature of the refrigerator may be raised or lowered according to operation of the compressor 110. In the same manner, when the compressor 110 is operated, the temperature of the thermal storage device 170 may be lowered, and when operation of the compressor 110 is stopped, the temperature of the thermal storage device 170 may rise.

If a user sets the electric charge saving mode and electric charges are relatively high at the present time, operation of the compressor 110 may be stopped. Then, the inner temperature of the refrigerator is raised, and the inside of the refrigerator is cooled using the thermal storage device 170. In this case, the switching valve 174 is opened or the pump 174 is operated. If the switching valve 174 is opened or the pump 174 is operated, the second refrigerant is circulated, and thus, cold air may be supplied to the inside of the refrigerator.

Although FIG. 11 illustrates only the opening and closing of the switching valve 174, opening of the switching valve 174 may be expressed in the same manner as operation of the pump 174, and closing of the switching valve 174 may be expressed in the same manner as stoppage of operation of the pump 174.

If the inner temperature of the refrigerator is raised to be higher than the critical temperature $T_{critical}$ although the cold air of the thermal storage device 170 is supplied to the inside of the refrigerator by the second refrigerant, the compressor 110 may be operated to cool the inside of the refrigerator.

Figure 12:
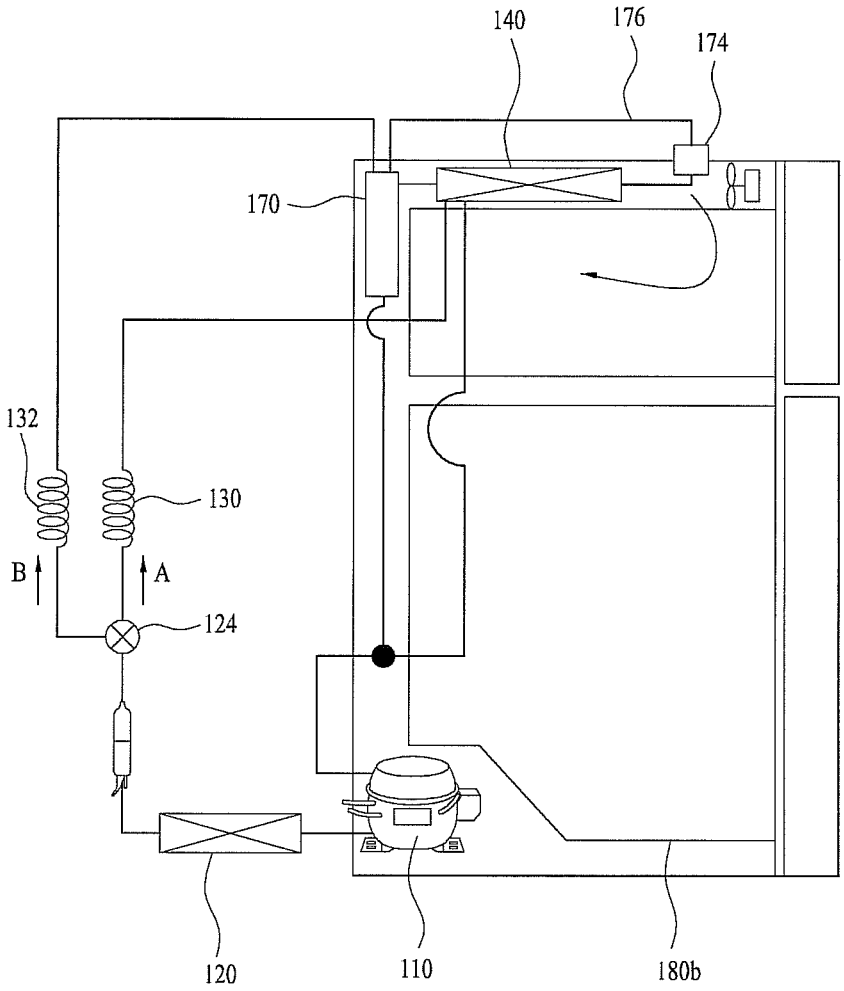
FIG. 12 is a schematic view illustrating an implemented state of the refrigerator in one embodiment.

FIG. 12 is a schematic view illustrating an implemented state of the refrigerator in accordance with the modification of FIG. 4. Hereinafter, the refrigerator in accordance with the latter modification of the first embodiment will be described with reference to FIGS. 4 and 12.

In FIG. 12, the capillary tube 130 and the sub-capillary tube 132 may be respectively provided, and the refrigerant having passed through the capillary tube 130 may move to the evaporator 140 to supply cold air to the inside of the refrigerator. On the other hand, the refrigerant having passed through the sub-capillary tube 132 may move to the thermal storage device 170 to store cold air within the thermal storage device 170.

General operation to cool the inside of the refrigerator and cold air storage operation to store cold air within the thermal storage device 170 may be divided from each other by the first direction change valve 124. That is, when the refrigerant path towards the capillary tube 130 is selected by the first direction change valve 124, general operation may be performed, and when the refrigerant path towards the sub-capillary tube 132 is selected by the first direction change valve 124, cold air storage operation may be performed. The operation pattern of the first direction change valve 124 may be determined in consideration of an amount of cold air stored in the thermal storage device 170 or a cold air storage time.

During a cooling operation using the thermal storage device 170, circulation of the refrigerant between the thermal storage device 170 and the evaporator 140 connected to the thermal storage device 170 by the induction pipe 176 may be carried out by the thermosyphon or through brine circulation. The configuration or function of heat exchange by the thermosyphon or through brine circulation is the same as in the above-described embodiment, and a detailed description thereof will thus be omitted.

Figure 13:
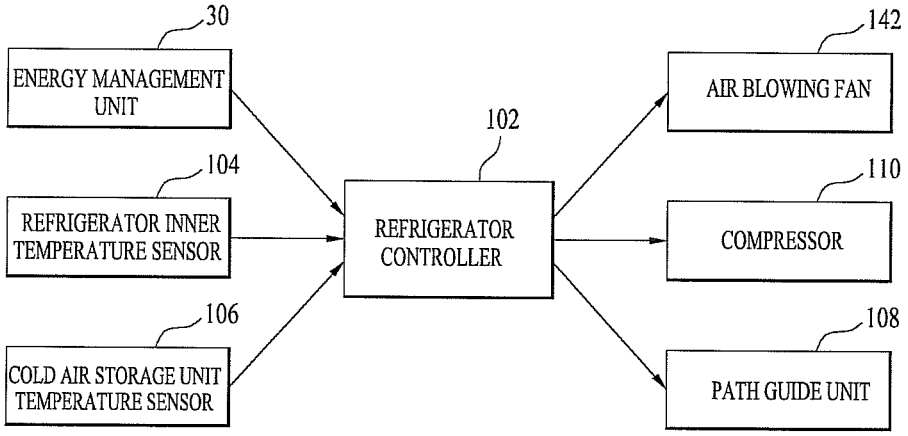
FIG. 13 is a block diagram of a refrigerator in accordance with one embodiment of the present disclosure.

FIG. 13 is a block diagram of a refrigerator in accordance with another embodiment of the present disclosure. Hereinafter, the refrigerator in accordance with the second embodiment of the present disclosure will be described with reference to FIG. 13.

An energy management device 30 may receive and transmit information regarding power supply time at which electric charges are varied to a refrigerator controller 102. That is, the energy management device 30 may receive information associated with power from an external source and transmit the information to the refrigerant controller 102. The information associated with power may be information regarding whether or not electric charges at the current time are higher or lower than electric charges at other times.

Further, a refrigerator inner temperature sensor 104 may sense an inner temperature of the refrigerator and a thermal storage device temperature sensor 106 may sense a temperature of a thermal storage device, and then the refrigerator inner temperature sensor 104 and the thermal storage device temperature sensor 106 may transmit the sensed temperatures to the refrigerator controller 102. The refrigerator inner temperature sensor 104 may be exposed to the inside of the refrigerator to measure the inner temperature of the refrigerator, and the thermal storage device temperature sensor 106 may contact the thermal storage device to measure the temperature of the thermal storage device.

The refrigerator controller 102 may operate the refrigerator in an electric charge saving manner according to information transmitted from the energy management device 30, whether or not a user sets an electric charge saving mode and whether or not electric charges of the current time are relatively low.

The refrigerator controller 102 may turns an air blowing fan 142 generating an air flow on/off, and may operate a compressor 110 constituting a refrigerating cycle. Further, the refrigerator controller 102 may control a path of a refrigerant using a path guide unit 108. The path guide unit 108 may include a first direction change valve and a second direction change valve which will be described later. The first direction change valve is installed at the front end of an evaporator, and the second direction change valve is installed at the rear end of the evaporator. Here, the air blowing fan 142 may be installed adjacent to the thermal storage device.

Particularly, the refrigerator controller 102 may control the path guide unit 108 according to power information (electric rate information) transmitted from the energy management device 30. Here, the power information may be information regarding electric power supply time at which electric charges are varied, e.g., during peak rate periods.

Figure 14:
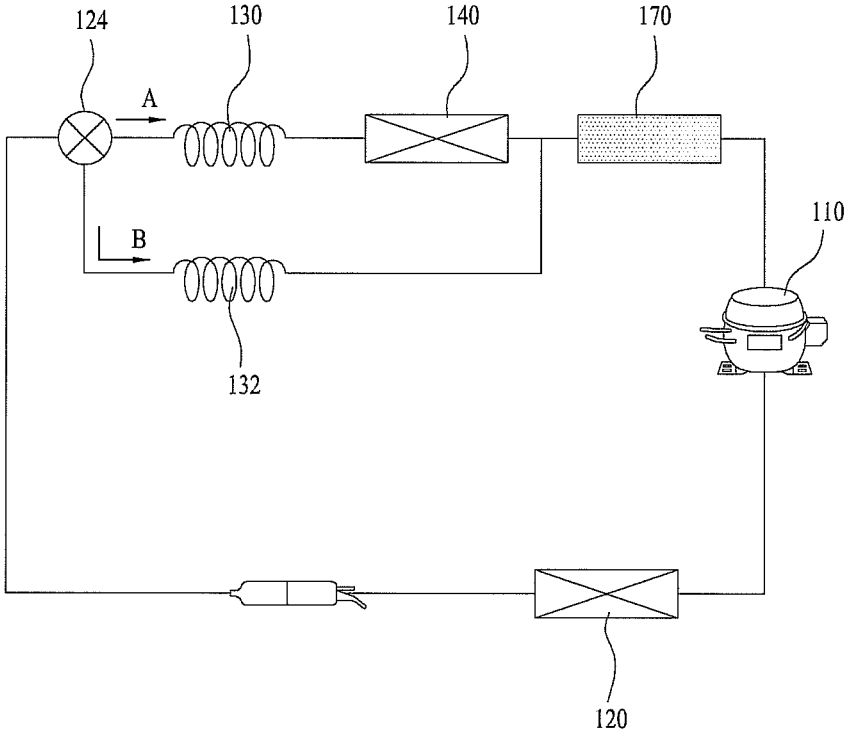
FIG. 14 is a circuit diagram illustrating a configuration of the refrigerator of FIG. 13.

FIG. 14 is a circuit diagram illustrating a configuration of the refrigerator in accordance with the embodiment of FIG. 13. Hereinafter, the configuration of the refrigerator in accordance with the second embodiment will be described with reference to FIG. 14.

In the embodiment shown in FIG. 14, a thermal storage device 170 may be disposed at the rear end of an evaporator 140, e.g., it may be coupled to the outlet port of the evaporator 140. Here, the rear end of the evaporator 140 may be set based on a moving direction of a refrigerant circulating through the refrigerating cycle, and means the position to which the refrigerant moves after passing through the evaporator 140. That is, the refrigerant moves to the thermal storage device 170 after passing through the evaporator 140.

The thermal storage device 170 may be installed in a space between an outer case and an inner case of the refrigerator, or may be installed in the inner case to be exposed directly to food, etc., stored in the refrigerator.

With reference to FIG. 14, when the refrigerant having passed through a compressor 110, a condenser 120, a capillary tube 130 and the evaporator 140 contacts the thermal storage device 170 or the case of the thermal storage device 170, the refrigerant may directly cool the thermal storage device 170.

The thermal storage device 170 may be cooled by heat exchange with the refrigerant circulating through the refrigerating cycle through conduction. Since the thermal storage device 170 may be cooled by conduction in which energy is transmitted by contact, cold air of the refrigerant may be effectively transmitted to the thermal storage device 170.

The refrigerator may includes a first direction change valve 124 that branches the refrigerant in front of the capillary tube 130, and a sub-capillary tube 132 lowering the temperature and pressure of the refrigerant branched by the first direction change valve 124. The first direction change valve 124 may be installed between the capillary tube 130 and the condenser 120 from among passages through which the refrigerant moves, and thus may allow the refrigerant to flow along one passage selected from a passage towards the capillary tube 130 and a passage towards the sub-capillary tube 132. The sub-capillary tube 132 may be disposed in parallel with the capillary tube 130 and the evaporator 140, and thus the refrigerant, the path of which is changed by the first direction change valve, may move along the sub-capillary tube 132.

The refrigerant having passed through the sub-capillary tube 132 and the refrigerant having passed through the evaporator 140 may be mixed or individually provided, and be then guided to the thermal storage device 170. That is, the refrigerant having passed through the sub-capillary tube 132 and the refrigerant having passed through the capillary tube 130 and the evaporator 140 may be collected at the front end of the thermal storage device 170.

With reference to FIG. 14, if the capillary tube 130 is selected as the path of the refrigerant by the first direction change valve 124 (the position A), the refrigerant passes through the capillary tube 130 and is then evaporated by the evaporator 140 to cool the inner chambers of the refrigerator in a normal manner. After cooling of the inside of the refrigerator is carried out by the evaporator 140, the thermal storage device 170 may be cooled using the remaining cold air.

On the other hand, if the sub-capillary tube 132 is selected as the path of the refrigerant by the first direction change valve 124 (the position B), the refrigerant passes through the sub-capillary tube 132, and then moves to the thermal storage device 170 to cool the thermal storage device 170. Such a first direction change valve 124 may be controlled by the refrigerator controller 102.

Selection of the path by the first direction change valve 124 may be determined according to whether or not cold air is first supplied to the inside of the refrigerator to lower the inner temperature of the refrigerator or cold air is first supplied to the thermal storage device 170 to be stored in the thermal storage device 170. For example, if the inner temperature of the refrigerator is sufficiently low, the first direction change valve 124 may select the sub-capillary tube 132 as the path of the refrigerant to rapidly charge the thermal storage device 170 with cold air. On the other hand, in a situation in which cold air needs to be supplied to the refrigerator, the first direction change valve 124 may select the capillary tube 130 and the evaporator 140 as the path of the refrigerant. The inner temperature of the refrigerator may be a pre-stored valve.

Figure 15:
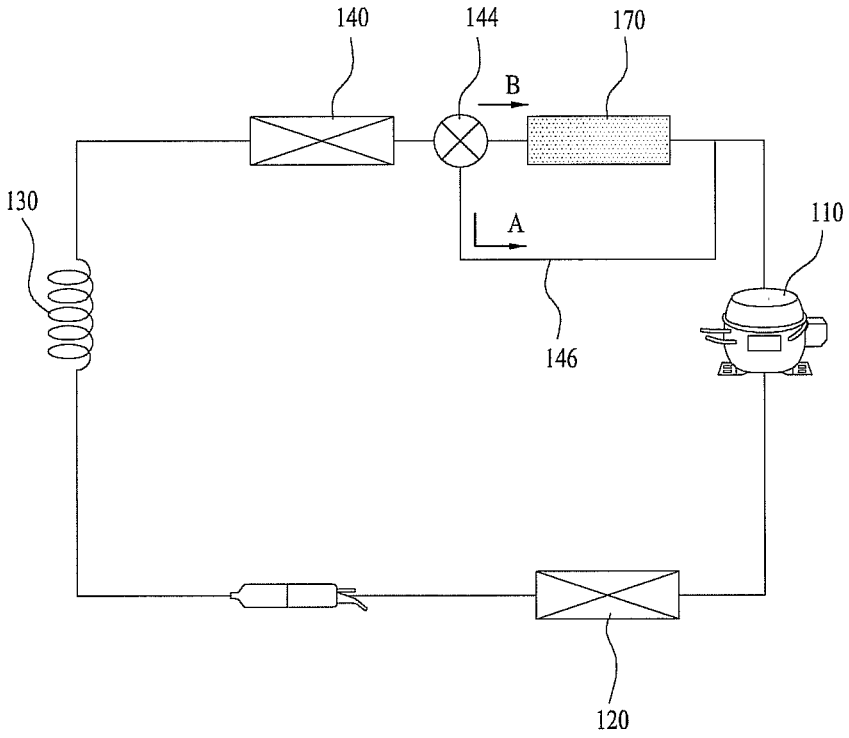
FIG. 15 is a circuit diagram illustrating a configuration of a refrigerator in accordance with one embodiment of the present disclosure.

FIG. 15 is a circuit diagram illustrating a configuration of a refrigerator in accordance with one embodiment of the present disclosure. This embodiment may be a modification of the embodiment of FIG. 14. Hereinafter, the refrigerator in accordance with such a modification of the second embodiment will be described with reference to FIG. 15.

The refrigerator in accordance with the modification of the embodiment shown in FIG. 15 further includes a second direction change valve 144 that branches a refrigerant at the rear of the evaporator 140, and a bypass tube 146 guiding the refrigerant branched by the second direction change valve 14. That is, the bypass tube 146 may be disposed in parallel with the thermal storage device 170 based on the direction of the refrigerating cycle.

The second direction change valve 144 may be installed between the evaporator 140 and the thermal storage device 170 from among passages through which the refrigerant moves, and thus, may be used to select whether or not the refrigerant having passed through the evaporator 140 is routed through the thermal storage device 170. If the refrigerant passes through the thermal storage device 170 (the position B), the thermal storage device 170 may be cooled, and if the path of the refrigerant is changed to the bypass tube 146 (the position A), the thermal storage device 170 is not cooled.

For example, if it is necessary to cool the thermal storage device 170, the second direction change valve 144 selects the path of the refrigerant towards the thermal storage device 170. This may be performed if cold air is not sufficiently stored in the thermal storage device 170.

On the other hand, if it is not necessary to cool the thermal storage device 170, e.g., if the thermal storage device 170 is sufficiently cooled, the second direction change valve 144 may be controlled to select the path of the refrigerant to be towards the bypass tube 146. In this case, the refrigerant does not pass through the thermal storage device 170 but moves directly to the compressor 110, thus implementing the general refrigerating cycle or normal operation of the main cooling circuit.

Figure 16:
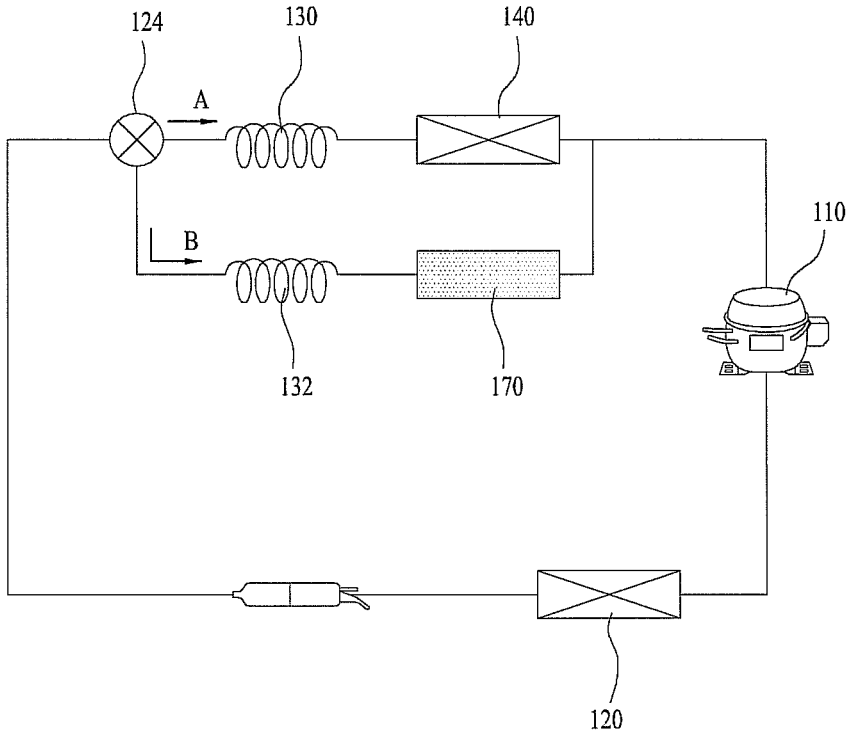
FIG. 16 is a circuit diagram illustrating a configuration of a refrigerator in accordance with one embodiment of the present disclosure.

FIG. 16 is a circuit diagram illustrating a configuration of a refrigerator in accordance with another embodiment of the present disclosure. Hereinafter, the refrigerator in accordance with such a modification of the second embodiment will be described with reference to FIG. 16.

The refrigerator may include a first direction change valve 124 branching a refrigerant having passed through the condenser 120, and a sub-capillary tube 132 installed at the rear of the first direction change valve 124. Here, the thermal storage device 170 may be disposed at the rear end of the sub-capillary tube 132, e.g., it may be coupled to an outlet port of the sub-capillary tube 132.

The capillary tube 130 and the evaporator 140 may be disposed in parallel with the sub-capillary tube 132 and the thermal storage device 170 based on the direction of the refrigerating cycle. The refrigerant having passed through the capillary tube 130 and the evaporator 140 and the refrigerant having passed through the sub-capillary tube 132 and the thermal storage device 170 are collected at the rear of the evaporator 140 and the thermal storage device 170.

With reference to FIG. 16, the refrigerant circulating through the refrigerating cycle may flow along one selected from a path towards the capillary tube 130 and a path towards the sub-capillary tube 132 by the first direction change valve 124. If the capillary tube 130 is selected as the path of the refrigerant (the position A), the refrigerant flows to the evaporator 140 and thus the inside of the refrigerator may be cooled.

On the other hand, if the sub-capillary tube 132 is selected as the path of the refrigerant (the position B), the first refrigerant flows to the thermal storage device 170, and thus, the thermal storage device 170 may be cooled and cold air may be stored in the thermal storage device 170. Of course, if the thermal storage device 170 is located within the refrigerator, the inside of the refrigerator may be cooled together with cooling of the thermal storage device 170. However, cooling efficiency in the case that the refrigerant moves to the thermal storage device 170 may be lower than cooling efficiency in the case that the refrigerant moves to the evaporator 140.

If the main object is to lower the inner temperature of the refrigerator, the first direction change valve 124 may move the refrigerant to the evaporator 140, and if the inner temperature of the refrigerator is sufficiently lowered and it is necessary to store cold air within the thermal storage device 170, the first direction change valve 124 may move the refrigerant to the thermal storage device 170.

The refrigerant having passed through the thermal storage device 170 is mixed with the refrigerant having passed through the evaporator 140 or is individually transmitted, and is then guided to the compressor 110, thereby constituting the general refrigerating cycle. That is, although the capillary tube 130 or the sub-capillary tube 132 is selected as the path of the refrigerant through the first direction change valve 124, all the refrigerant moves to the compressor 110.

Figure 17:
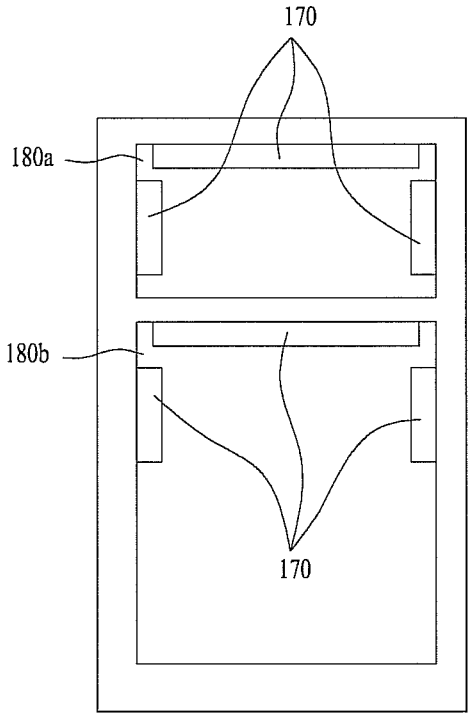
FIG. 17 is a front longitudinal-sectional view of a refrigerator.
Figure 18:
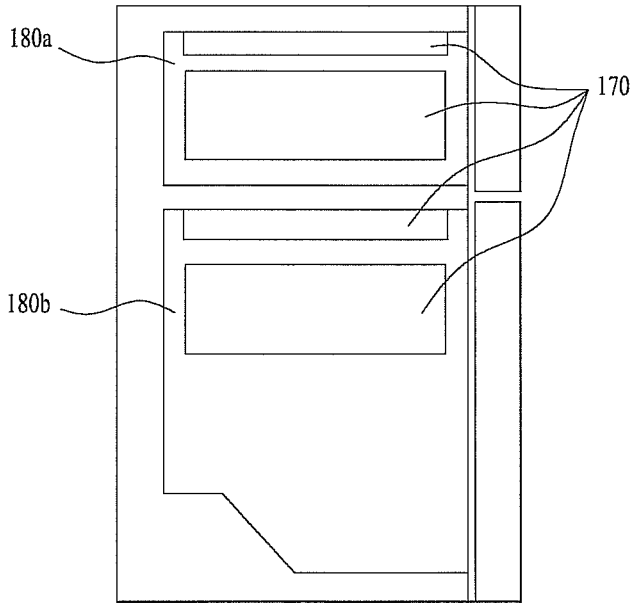
FIG. 18 is a side longitudinal-sectional view of a refrigerator.

FIG. 17 is a front longitudinal-sectional view of the refrigerator, and FIG. 18 is a side longitudinal-sectional view of the refrigerator. An example of cold air emission shown in FIGS. 17 and 18 employs a direct cooling type in which a separate air blowing fan is not necessary to transmit cold air of the thermal storage device 170 to a refrigerating chamber 180*b* or a freezing chamber 180*a*. Since the thermal storage device 170 may be exposed to the inner space of the refrigerator, cold air energy stored in the thermal storage device 170 may be supplied to the inside of the refrigerator by natural convection.

In more detail, the thermal storage device 170 may be attached to the inner case forming a designated space therein. Further, a plurality of thermal storage devices 170 may be installed on the inner case so as to store a sufficient amount of cold air.

The thermal storage devices 170 may be respectively installed on the upper and side surfaces of the inner case. When the thermal storage devices 170 are installed in a wide range on various surfaces of the inner case, although a phase change material having the same amount is used, the thermal storage devices 170 may have greater contact area with air within the inner case. When the contact area of the thermal storage devices 170 with air increases, cold air stored in the thermal storage devices 170 may be effectively transmitted to the inside of the inner case.

As shown in FIGS. 17 and 18, the thermal storage devices 170 include thermal storage devices for refrigerating chambers which are installed on the refrigerating chamber 180*b* of the inner case, and thermal storage devices for freezing chambers which are installed on the freezing chamber 180*a* of the inner case. The thermal storage devices for refrigerating chambers and the thermal storage devices for freezing chambers may be divided according to installation positions thereof. That is, a plurality of thermal storage devices 170 may be installed on the inner case, and the plural thermal storage devices 170 may be separately installed on the freezing chamber 180*a* and the refrigerating chamber 180*b*.

Since the temperatures of the freezing chamber 180*a* and the refrigerating chamber 180*b* are different, the thermal storage devices 170 installed on the freezing chamber 180*a* and the thermal storage devices 170 installed on the refrigerating chamber 180*a* may have different sizes or may be formed of different materials such that the thermal storage devices 170 installed on the freezing chamber 180*a* contains a larger amount of energy for cold air than the thermal storage devices 170 installed on the refrigerating chamber 180*b*. If the thermal storage devices 170 are exposed to the inside of the inner case, cold air energy stored in the thermal storage devices 170 may be used to cool the inside of the refrigerator by natural convection without a separate air blowing fan.

Differently from the direct cold air emission method shown in FIGS. 17 and 18, an direct cold air emission method in which a separate air blowing fan 142 is installed adjacent to the thermal storage device 170 to supply cold air stored in the thermal storage device 170 to the inside of the refrigerator may be employed. Here, the air blowing fan 142 may be operated to transmit cold air stored in the thermal storage device 170 to the inside of the refrigerator, for example, when electric charges are high.

Figure 19:
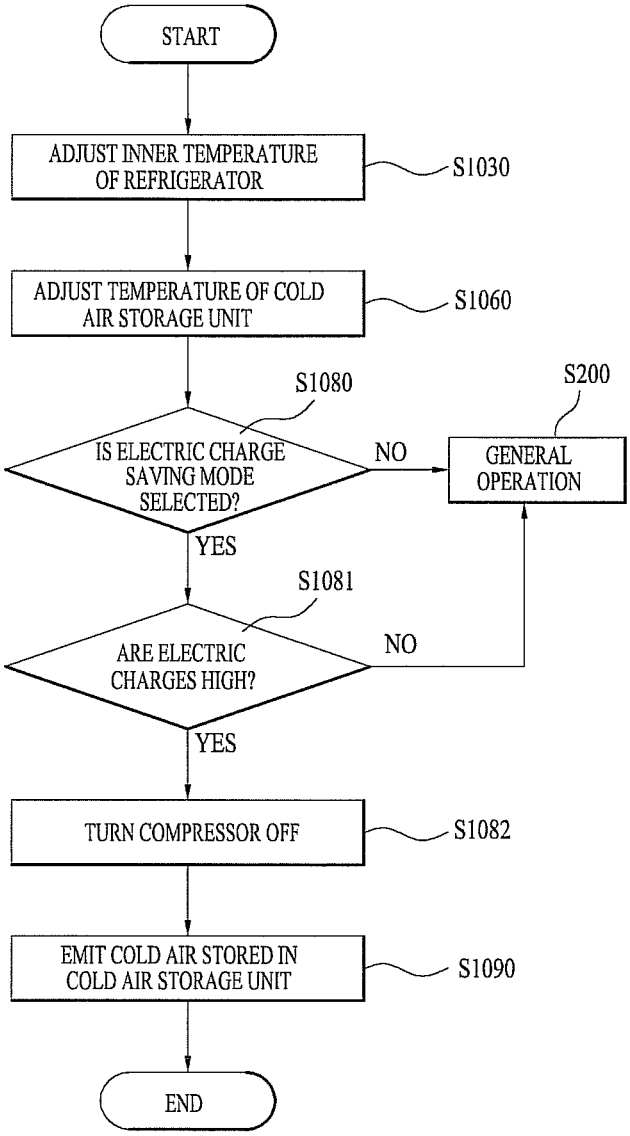
FIG. 19 is a flowchart illustrating a control process of refrigerator in accordance with the embodiment of FIG. 13.

FIG. 19 is a flowchart illustrating the overall control process of the refrigerator in accordance with the embodiment of FIG. 13. Hereinafter, the overall control process of the refrigerator in accordance with the second embodiment will be described with reference to FIG. 19.

First, the inner temperature of the refrigerator may be adjusted, in step S1030. Since food is stored within the refrigerator, the above-described compressor 110, etc. are operated to sufficiently lower the inner temperature of the refrigerator. Thereafter, the temperature of the thermal storage device 170 may be adjusted, in step S1060. The thermal storage device 170 may store cold air generated by the compressor 110, etc.

Whether or not the electric charge saving mode is set by a user is judged, in step S1080. Upon judging that the electric charge saving mode is not set by the user, it may be judged that it is not necessary to save electric charges and general operation is performed, in step S200. During general operation, a process of cooling the inside of the refrigerator by the general refrigerating cycle or a process of storing cold air within the thermal storage device 170 may be performed. That is, general operation refers to a state in which the refrigerator is generally or normally operated regardless of whether or not electric charges are high. Such general operation may have the same meaning as the above-described operation in an original set state.

Upon judging that the electric charge saving mode is set by the user, whether or not electric charges are high is judged, in step S1081. Whether or not electric charges are high may be judged using information transmitted from the energy management device 30. That is, if a power supply time corresponds to a first time section, it may be judged that electric charges are relatively high, and if the power supply time corresponds to a second time section, it may be judged that electric charges are relatively low.

Upon judging that electric charges are high, operation of the compressor 110 is first stopped, in step S1082. The reason for this is that, if the compressor 110 is operated when electric charges are high, a relatively high electric fee may result. In order to minimize electric power costs, the thermal storage device 170 may be used to temporarily cool the refrigerator.

Thereafter, thermal energy stored in the thermal storage device 170 may be used to emit cool the air to the inside of the refrigerator to cool the inside of the refrigerator, in step S1090. However, upon judging that the power supply time corresponds to the second time section, and thus, electric charges are relatively low, although the electric charge saving mode is set, the above-described general operation may be performed, in step S200.

Figure 20:
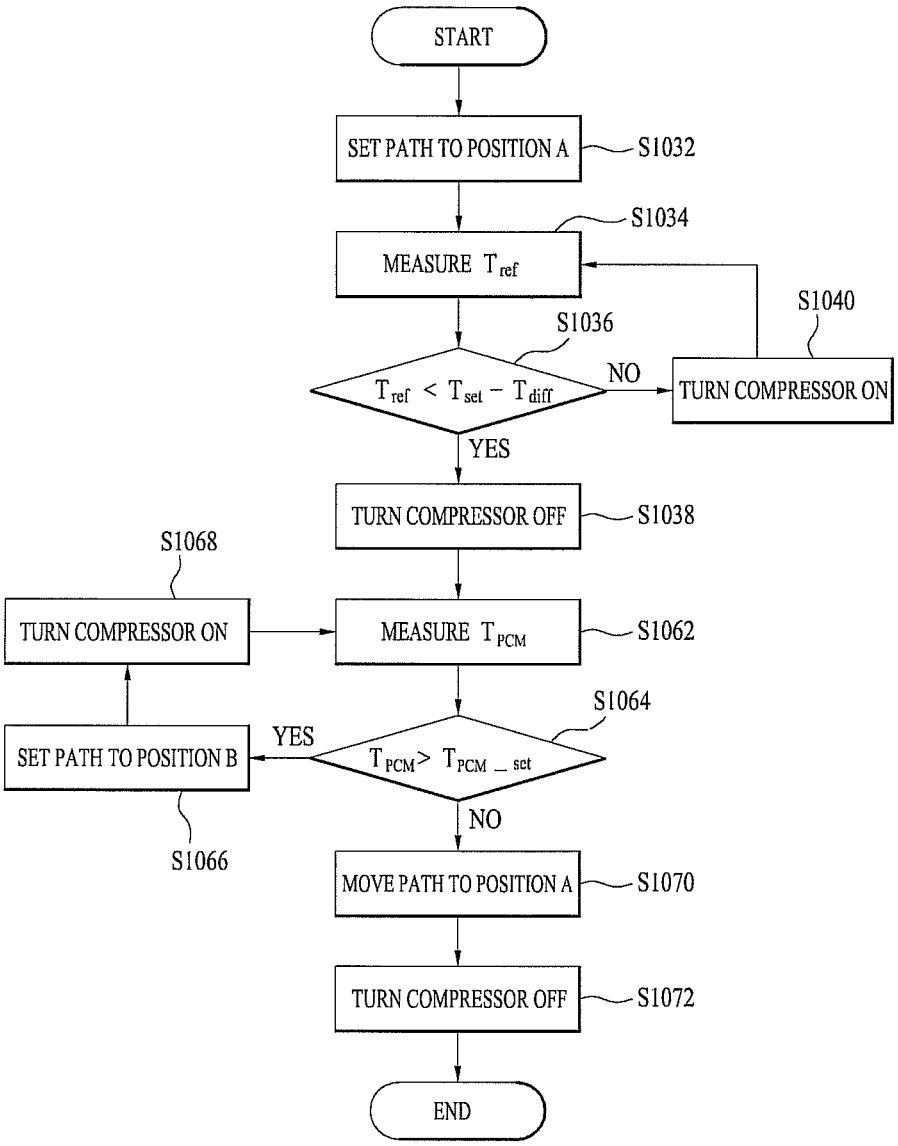
FIG. 20 is a flowchart illustrating a control process of refrigerator inside cooling and cold air storage in the refrigerator of FIG. 19.

FIG. 20 is a flowchart illustrating the detailed control process of refrigerator inside cooling and cold air storage in the refrigerator of FIG. 19. Hereinafter, the detailed control process of refrigerator inside cooling and cold air storage will be described with reference to FIG. 20.

First, the path of the path guide unit 108 is set to the position A, in step S1032. The position A refers to a state in which the thermal storage device 170 is not being recharged using the compressor 110, or a state in which rate of cooling the inner chambers of the refrigerator is greater than when the path is set to the position B. When the path is set to position A, the thermal storage device 170 may be bypassed, enhancing the efficiency of the cooling circuit to cool the refrigerator chambers.

Thereafter, an inner temperature $T_{ref}$ of the refrigerator is measured by the refrigerator inner temperature sensor 104, in step S1034. Thereafter, whether or not the measured inner temperature $T_{ref}$ of the refrigerator is lower than an allowable range limit value $T_{set}-T_{diff}$ of a set inner temperature of the refrigerator is judged, in step S1036.

Thereafter, upon judging that the measured inner temperature $T_{ref}$ of the refrigerator is not lower than the allowable range limit value ($T_{set}-T_{diff}$), it is judged that it is necessary to cool the inside of the refrigerator and thus the compressor 110 is operated to cool the inside of the refrigerator, in step S1040.

On the other hand, upon judging that the measured inner temperature $T_{ref}$ of the refrigerator is lower than the allowable range limit value ($T_{set}-T_{diff}$), operation of the compressor 110 is stopped, in step S1038. The reason for this is that, if the measured inner temperature $T_{ref}$ of the refrigerator is lower than the allowable range limit value ($T_{set}-T_{diff}$), it is judged that it is not necessary to cool the inside of the refrigerator any longer. Under the condition that operation of the compressor 110 is stopped in an initial stage, step S1038 may be omitted.

Thereafter, a temperature $T_{PCM}$ of the thermal storage device 170 is measured by the thermal storage device temperature sensor 106, in step S1062. If the temperature $T_{PCM}$ of the thermal storage device 170 is higher than a thermal storage device set temperature $T_{PCM_set}$, it is judged that it is necessary to store cold air within the thermal storage device 170 (e.g., recharge the thermal storage device), and the path guide unit 108 is controlled such that the refrigerant flows to the position B, in step S1066.

When the refrigerant flows to the position B, a larger amount of cold air than at the position A may be stored, or all of the cold air generated from the compressor 110 may be stored. Then, the compressor 110 may be operated to store cold air within the thermal storage device 170, in step S1068.

On the other hand, if the temperature $T_{PCM}$ of the thermal storage device 170 is not higher than the thermal storage device set temperature $T_{PCM_set}$, the path guide unit 108 is controlled such that the refrigerant flows to the position A, in step S1070. Here, when the path guide unit 108 is set in advance such that the refrigerant flows to the position A, step S1070 may be omitted. Thereafter, operation of the compressor 110 is stopped, in step S1072. Further, S1072 may also be omitted under the condition that the compressor 110 is not operated.

Figure 21:
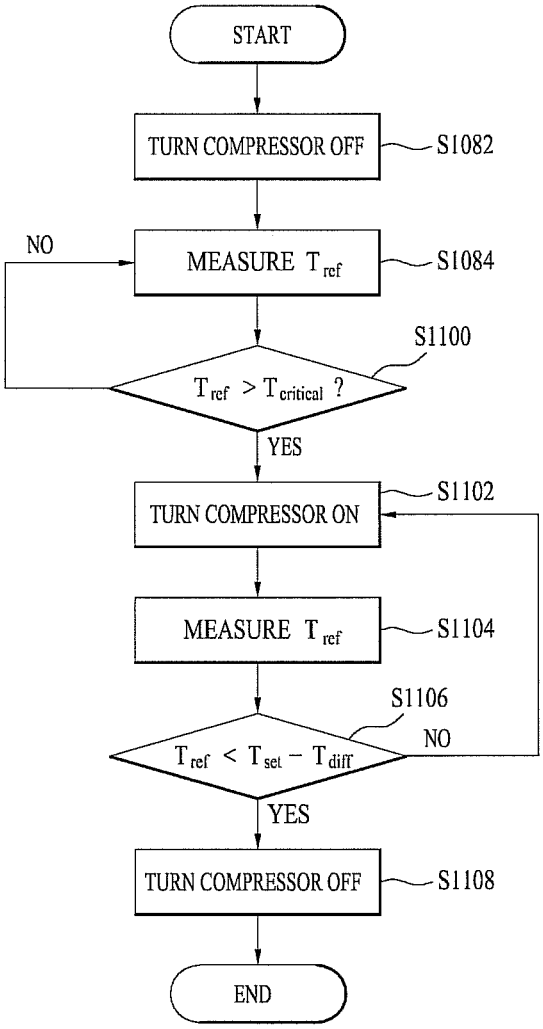
FIG. 21 is a flowchart illustrating a control process of direct cold air emission in the refrigerator of FIG. 19.

FIG. 21 is a flowchart illustrating a detailed control process of direct cold air emission in the refrigerator of FIG. 19, during period in which electric rates are high. FIG. 21 is a flowchart illustrates a situation where an electric charge saving mode has been set (e.g., by a user) and a power supply time corresponds to the first time section. If the power supply time corresponds to the second time section although the electric charge saving mode is set by the user, the control process of FIG. 21 is not performed. Hereinafter, the control process of direct cold air emission will be described with reference to FIG. 21.

First, operation of the compressor 110 is stopped, in step S1082. The reason for this is that, if the compressor 110 is operated when electric charges are relatively high, high an electric fee may result. Since operation of the compressor 110 is stopped, the inner temperature of the refrigerator may gradually rise. When the inner temperature of the refrigerator reaches a designated temperature, cold air stored in the thermal storage device 170 is supplied to the inside of the refrigerator, and may thus lower the inner temperature of the refrigerator.

Particularly, the flow of FIG. 21 relates to direct cold air emission, and may be performed under the condition that the thermal storage device 170 is exposed to the inside of the refrigerator, as shown in FIGS. 17 and 18. Therefore, the inside of the refrigerator may be cooled without a separate driving device to supply cold air stored in the thermal storage device 170 to the inside of the refrigerator.

Further, since the thermal storage device 170 may be exposed to the inside of the refrigerator, it may not be necessary to control the thermal storage device 170 to emit cold air energy stored in the thermal storage device 170 according to whether or not the inner temperature of the refrigerator is raised by a designated temperature or more. The reason for this is that, if the inner temperature of the refrigerator is raised, the temperature of the thermal storage device 170 is raised more slowly than the inner temperature of the refrigerator, there is a temperature difference between the inside of the refrigerator and the thermal storage device 170, and thus, the inside of the refrigerator may be naturally cooled by convection.

Thereafter, an inner temperature $T_{ref}$ of the refrigerator is measured by the refrigerator inner temperature sensor 104, in step S1084. Thereafter, whether or not the inner temperature $T_{ref}$ of the refrigerator measured by the refrigerant inner temperature sensor 104 is higher than a critical temperature $T_{critical}$ is judged, in step S1100. If the measured inner temperature Tref of the refrigerator is higher than the critical temperature $T_{critical}$, it is judged that there is a possibility of food stored in the refrigerator may be damaged, and thus, the compressor 110 is operated regardless of whether or not electric charges are high, in step S1102.

Thereafter, the inner temperature $T_{ref}$ of the refrigerator is continuously measured, in step S1106, and if the measured inner temperature $T_{ref}$ of the refrigerator is lower than an allowable range limit value $T_{set}-T_{diff}$ of a set inner temperature of the refrigerator, operation of the compressor 110 is stopped, in step S1108. The reason for this is that it may be judged that the inner temperature $T_{ref}$ of the refrigerator is sufficiently lowered and the inside of the refrigerator is sufficiently cooled.

Figure 22:
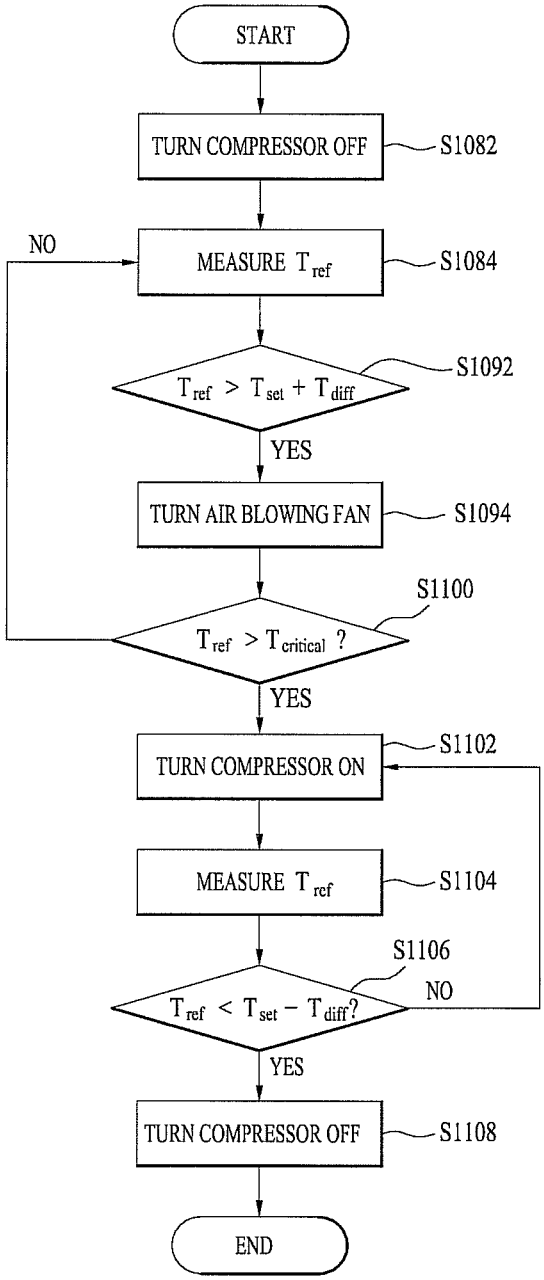
FIG. 22 is a flowchart illustrating a control process of indirect cold air emission in the refrigerator of FIG. 19.

FIG. 22 is a flowchart illustrating the detailed control process of indirect cold air emission in the refrigerator of FIG. 19, when electric rates are high. FIG. 22 is a flowchart if an electric charge saving mode has been set (e.g., by a user) and a power supply time corresponds to the first time section. If the power supply time corresponds to the second time section, although the electric charge saving mode is set by the user, the control process of FIG. 22 is not performed. Hereinafter, the control process of indirect cold air emission will be described with reference to FIG. 22.

The flow of FIG. 22 is similar to the flow of FIG. 21, but differs from the flow of FIG. 21 in that cooling of the inside of the refrigerator is indirectly carried out. That is, indirect cold air emission of FIG. 22 employs a method in which the thermal storage device 170 is not exposed to the inside of the refrigerator, and thus, a separate air blowing fan 142 may be used to emit cold air using the energy stored in the thermal storage device 170 to the inside of the refrigerator.

Operations of FIG. 22 which are the same as those of FIG. 21 will be omitted, and only operations of FIG. 22 which differ from those of FIG. 21 will be described. An inner temperature $T_{ref}$ of the refrigerator is measured by the refrigerator inner temperature sensor 104, in step S1084. If the measured inner temperature $T_{ref}$ of the refrigerator is higher than an allowable range limit value $T_{set}+T_{diff}$ of a set inner temperature of the refrigerator, it may be judged that it is necessary to cool the inside of the refrigerator.

Thereafter, the air blowing fan 142 is operated to supply cold air from energy stored in the thermal storage device 170 to the inside of the refrigerator, in step S1094. The air blowing fan 142 may generate forcible convection in the thermal storage device 170 and the refrigerator, thus cooling the inside of the refrigerator.

Figure 23:
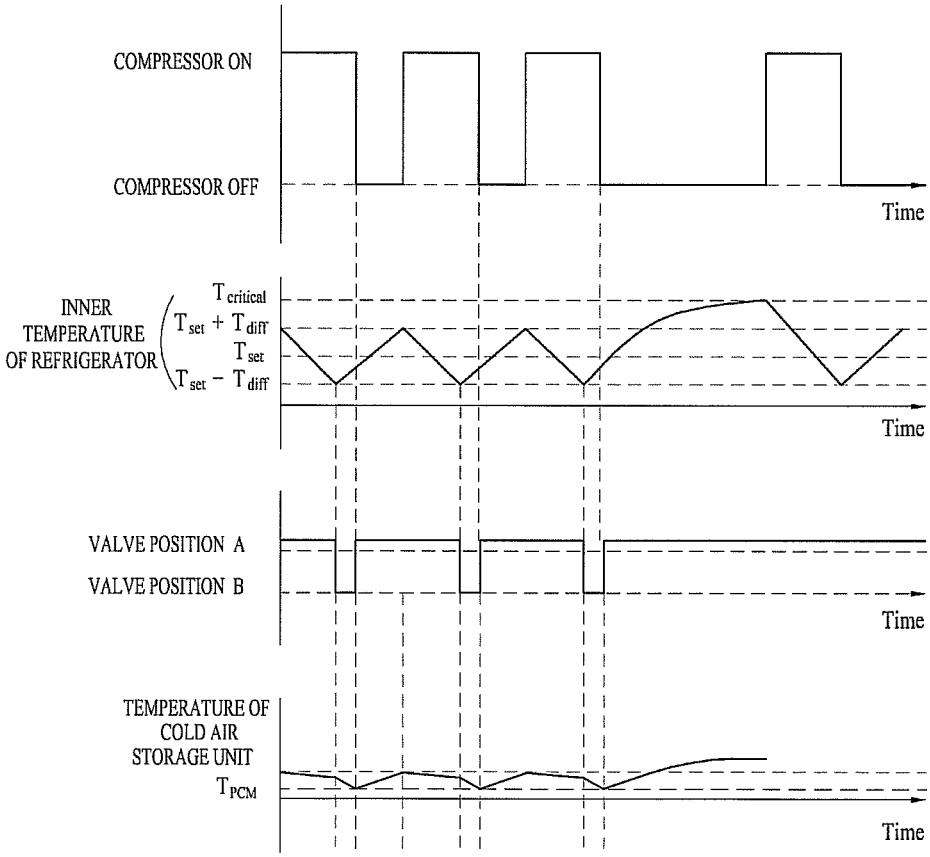
FIG. 23 is a graph illustrating an operation of components of the refrigerator based on time in accordance with the embodiment of FIG. 13.

FIG. 23 is a graph illustrating an operation of components of the refrigerator based on time in accordance with the embodiment of FIG. 13. Hereinafter, operation of the components of the refrigerator based on time will be described with reference to FIGS. 14 and 23.

The compressor 110 may be intermittently operated, and then operation of the compressor 110 is stopped if the electric charge saving mode is selected, and it is judged that the current time corresponds to the first time section in which electric charges are high. The inner temperature of the refrigerator is raised or lowered according to whether or not the compressor 110 is operated, and is then raised to the critical temperature $T_{critical}$ if operation of the compressor 110 is stopped and a designated time has elapsed. If the inner temperature of the refrigerator is raised to the critical temperature $T_{critical}$, the compressor 110 is operated to lower the inner temperature of the refrigerator.

The path guide unit 108 may be set to the position A or the position B. If the path guide unit 108 is set to the position A, the refrigerant is guided to the thermal storage device 170 after passing through the evaporator 140, and thus, a relatively small amount of cold air energy is stored in the thermal storage device 170. Here, the term 'relatively' may refer to a comparison with the case that the path guide unit 108 is set to the position B.

Therefore, the temperature of the thermal storage device 170 if the path guide unit 108 guides the refrigerant to the position B is lowered at a higher gradient than the temperature of the thermal storage device 170 if the path guide unit 108 guide the refrigerant to the position A. If the path guide unit 108 is set to the position B, the refrigerant is not guided to the evaporator 140, and thus, the inner temperature of the refrigerator is raised.

Figure 24:
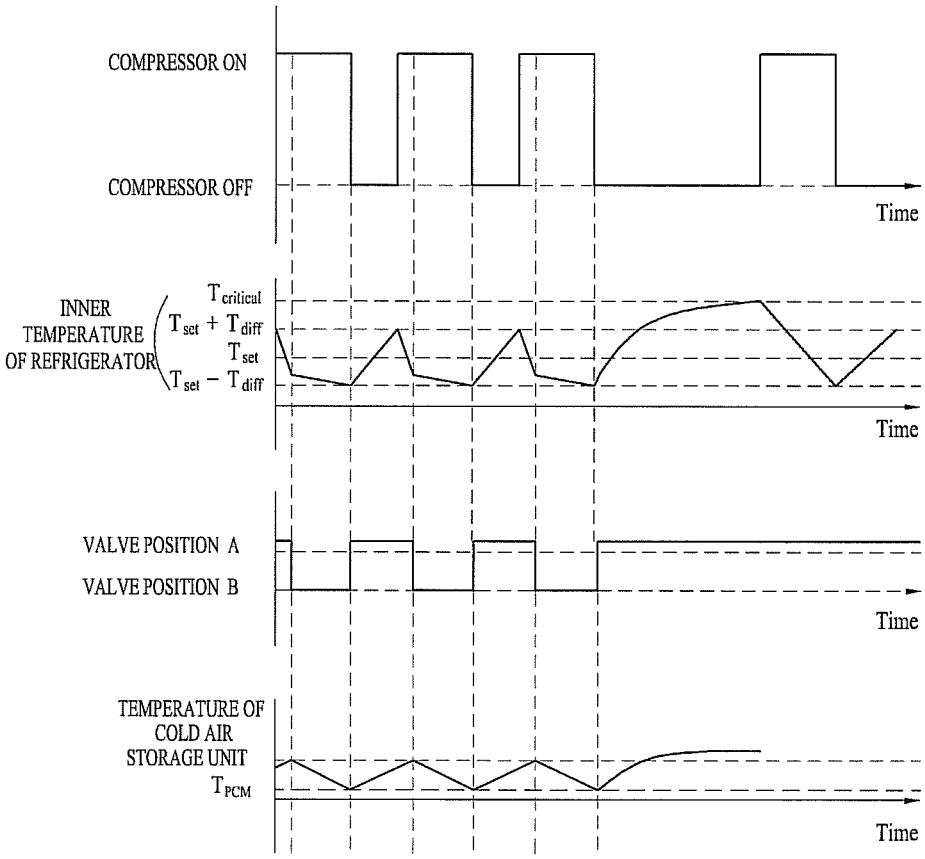
FIG. 24 is a graph illustrating an operation of components of the refrigerator based on time in accordance with one embodiment.

FIG. 24 is a graph illustrating an operation of components of the refrigerator based on time in accordance with an embodiment of FIG. 15. For convenience of description, only operations of FIG. 24 differing from those of FIG. 23 will be described. Hereinafter, operation of the components of the refrigerator based on time in accordance with the former modification of the second embodiment will be described with reference to FIGS. 15 and 24.

With reference to FIG. 24, the refrigerant may be guided to the position A or the position B by the path guide unit 108. If the refrigerant is guided to the position A, the refrigerant does not pass through the thermal storage device 170, and thus, the thermal storage device 170 is not recharged. Therefore, if the valve is located at the position A, the temperature of the thermal storage device 170 is not lowered, instead being raised, but only the inner temperature of the refrigerator is lowered.

On the other hand, if the valve is located at the position B, the refrigerant sequentially passes through the evaporator 140 and the thermal storage device 170, and thus, cooling of the inside of the refrigerator and storage of cold air within the thermal storage device 170 are simultaneously carried out. Therefore, the inner temperature of the refrigerator and the temperature of the thermal storage device 170 are simultaneously lowered in the corresponding section. The gradient of lowering of the inner temperature of the refrigerant if the valve is set to the position B is smaller than that of the inner temperature of the refrigerant if the valve is set to the position A.

Figure 25:
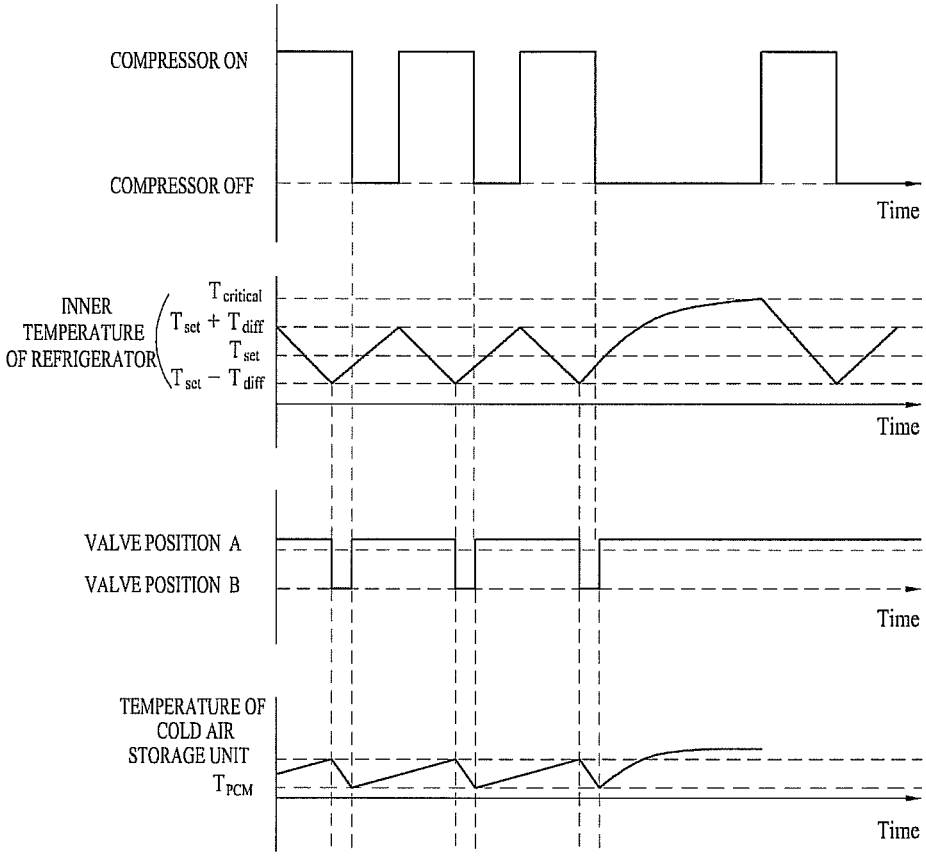
FIG. 25 is a view illustrating graphs representing operation of components of the refrigerator based on time in accordance with one embodiment.

FIG. 25 is a graph illustrating an operation of components of the refrigerator based on time in accordance with the embodiment of FIG. 16. For convenience of description, only operations of FIG. 25 differing from those of FIG. 23 will be described. Hereinafter, operation of the components of the refrigerator based on time in accordance with the latter modification of the second embodiment will be described with reference to FIGS. 16 and 25.

With reference to FIG. 25, the refrigerant may be guided to the position A or the position B by the path guide unit 108. If the refrigerant is guided to the position A, storage of cold air is not carried out in the same manner as in FIG. 24.

On the other hand, if the path is formed at the position B, a refrigerating cycle in which the refrigerant does not pass through the thermal storage device 170 but passes through only the evaporator 140 is formed differently from FIGS. 23 and 24. That is, the refrigerant may be guided to the thermal storage device 170 to achieve storage of cold air in the thermal storage device 170, or may be guided to the evaporator 140 to cool the inside of the refrigerator. Therefore, if the valve forms the path at the position A, the inner temperature of the refrigerator is lowered but the temperature of the thermal storage device 170 is not lowered. On the other hand, if the valve forms the path at the position B, the temperature of the thermal storage device 170 is lowered but the inner temperature of the refrigerator is not lowered. Therefore, in accordance with this modification of the second embodiment, a user may selectively control lowering of the inner temperature of the refrigerator and storage of cold air in the thermal storage device 170.

Figure 26:
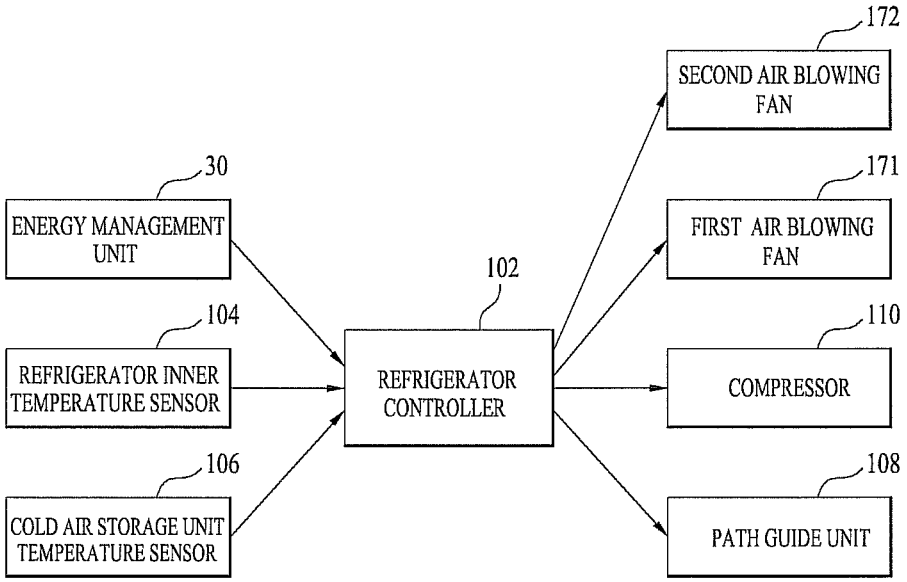
FIG. 26 is a block diagram of a refrigerator in accordance one embodiment of the present disclosure.

FIG. 26 is a block diagram of a refrigerator in accordance with one embodiment of the present disclosure. A refrigerator controller 102 may turn a first air blowing fan 171 generating air flow on/off so as to achieve heat exchange in an evaporator, or may adjust the rotating velocity of the first air blowing fan 171. Further, the refrigerator controller 102 may turn a second air blowing fan 172 generating air flow on/off so as to achieve heat exchange in a thermal storage device, or may adjust the rotating velocity of the second air blowing fan 172. The refrigerator controller 102 may operate a compressor 110 constituting the refrigerating cycle.

Further, the refrigerator controller 102 may control a path in which convection generating heat exchange using a path guide unit 108 is carried out. The path guide unit 108 may include a first damper and a second damper which will be described later. Although they will be described in detail with reference to FIGS. 27 and 10, the first damper may open and close a path so that heat exchange in the isolated thermal storage device is carried out, and the second damper may open and close a path so that heat exchange in the isolated thermal storage device and evaporator is carried out. Here, the evaporator may include the first air blowing fan 171, and the thermal storage device may include the second air blowing fan 172.

Figure 27:
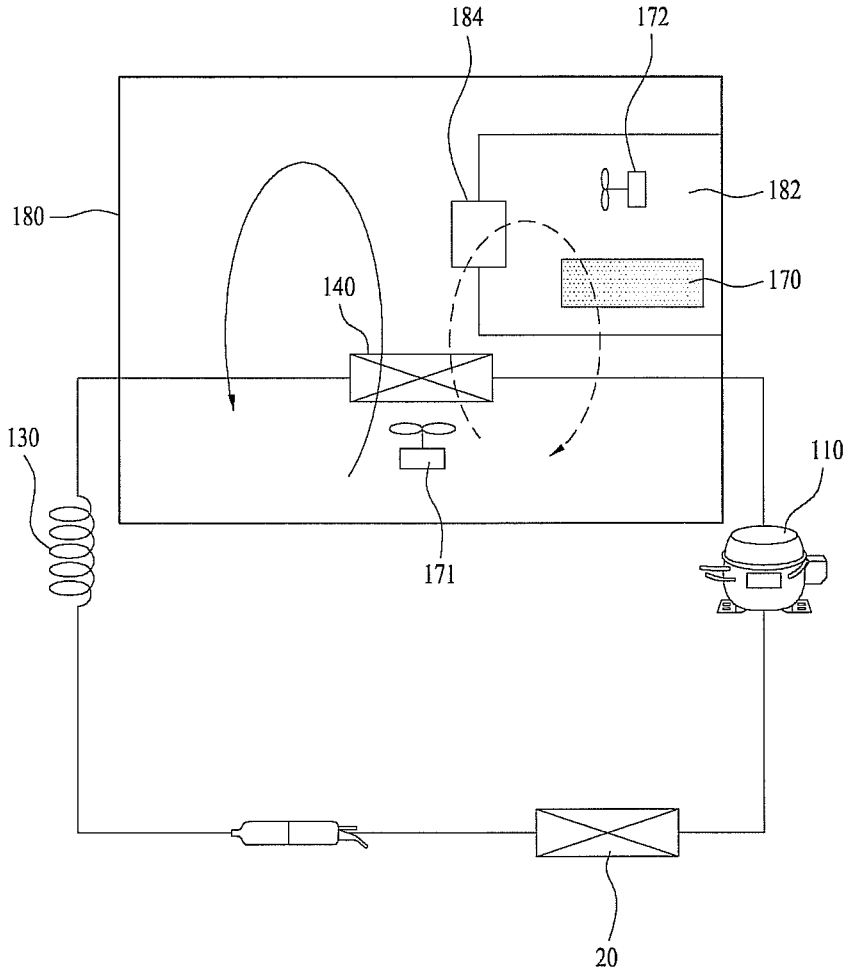
FIG. 27 is a circuit diagram illustrating a configuration of the refrigerator in accordance with the embodiment of FIG. 26.

FIG. 27 is a circuit diagram illustrating a configuration of the refrigerator in accordance with the embodiment of FIG. 26. The evaporator 140 may include the first air blowing fan 171 that generates convection. It should be appreciated that even when the first air blowing fan 171 is not provided, heat exchange may be carried out by natural convection due to temperature differences. However, in order to improve heat exchange efficiency between the evaporator 140 and the thermal storage device 170, the first air blowing fan 171 may be provided.

Further, the first air blowing fan 171 may be operated during operation of the compressor 110. The reason for this is that, when the compressor 110 is operated, the refrigerant is circulated through the compressor 110, the evaporator 140, etc. and thus, cold air may be emitted through the evaporator 140.

The refrigerator generally includes an outer case that forms the external appearance of the refrigerator, and an inner case 180 that forms an inner space to accommodate food. The evaporator 140 is installed on the inner case 180 forming the inner space, and a first chamber 182 isolated from the inner case 180 may be formed on the inner case 180. The thermal storage device 170 may be accommodated in the first chamber 182, and a first damper 184 selectively communicating the first chamber 182 and the inside of the inner case 180 with each other may be installed.

The thermal storage device 170 may undergo heat exchange with the refrigerant accommodated in the evaporator 140 circulating along the refrigerating cycle through convection, thus being cooled. That is, the thermal storage device 170 may not directly contact the refrigerant circulating along the refrigerating cycle or the pipe along which the refrigerant flows. Rather, the thermal storage device 170 may be cooled by undergoing heat exchange through natural convection or forced convection, thus storing energy therein to supply the cold air.

That is, although the refrigerant sequentially passes through the compressor 110, the condenser 120, the capillary tube 130 and the evaporator 140 to perform the refrigerating cycle, if the first damper 184 seals the first chamber 182, cold air is not transmitted to the thermal storage device 170. Therefore, storage of cold air within the thermal storage device 170 is not performed. On the other hand, if the first damper 184 opens the first chamber 182, the thermal storage device 170 may be cooled, and thus, cold air may be stored in the thermal storage device 170.

If the first damper 184 opens the first chamber 182, some of cold air may be stored in the thermal storage device 170, and thus, cold air may not be rapidly supplied to the inside of the inner case 180. Therefore, in order to rapidly cool the inside of the inner case 180, the first damper 184 may seal the first chamber 182.

The embodiment of FIG. 27 may be used when it is necessary to selectively perform control of a type in which the thermal storage device 170 does not absorb cold air and all of the generated cold air is used to cool the inside of the refrigerator. On the other hand, after the temperature of the inside of the refrigerator has been sufficiently lowered, the first damper 184 may open the first chamber 182 to store cold air energy in the thermal storage device 170.

On the other hand, in order to emit cold air from stored in the thermal storage device 170 to the inside of the refrigerator, the first damper 184 opens the first chamber 182. Further, the second air blowing fan 172 installed adjacent to the thermal storage device 170 may be operated to generate convection between the thermal storage device 170 and the inner case 180, thus facilitating heat exchange. Particularly, when the thermal storage device 170 is installed in the first chamber 182 which is sealed to a designated degree, forced convection is generated by the second air blowing fan 172.

Figure 28:
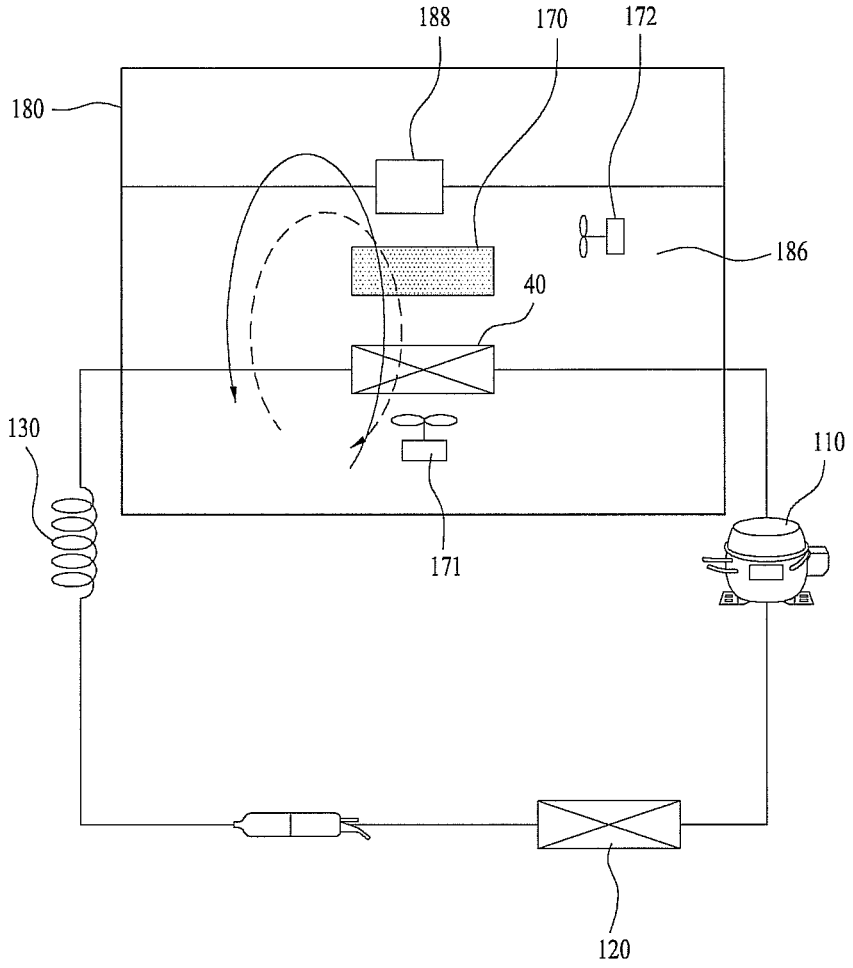
FIG. 28 is a circuit diagram illustrating a configuration of a refrigerator in accordance with one modification of the embodiment of FIG. 26.

FIG. 28 is a circuit diagram illustrating a configuration of a refrigerator in accordance with one modification of the embodiment of FIG. 27. Hereinafter, the main configuration of the refrigerator in accordance with the modification of the third embodiment will be described with reference to FIG. 28.

The refrigerator in this embodiment differs from the refrigerator in accordance with the embodiment of FIG. 27 in that a thermal storage device 170 and an evaporator 140 are disposed in the same space.

A second chamber 186, which is isolated from an inner case 180, may be formed in the inner case 180. The second chamber 186 may accommodate the evaporator 140 and the thermal storage device 170, and may be selectively sealed by a second damper 188 to be isolated from the inside of the inner case 180.

The second chamber 186 may be a space between the inner case 180 and an outer case of the refrigerator. That is, a separate space is not formed within the inner case 180, but the space formed between the inner case 180 and the outer case may be used as the second chamber 186 without changing the structure of the conventional refrigerator.

With reference to FIG. 28, cold air generated when the refrigerant passes through the evaporator 140 first cools the thermal storage device 170 disposed in the second chamber 186. Here, the thermal storage device 170 may be cooled regardless of whether or not the second damper 188 seals the second chamber 186. If the second damper 188 communicates the second chamber 186 and the inside of the inner case 180 with each other, cold air generated from the evaporator 140 may cool the inside of the inner case 180. On the other hand, if the second damper 188 seals the second chamber 186 from the inside of the inner case 180, cold air generated from the evaporator 140 is transmitted only to the thermal storage device 170, and thus, the thermal storage device 170 may rapidly store energy for cold air.

If the first air blowing fan 171 is operated, forced convection is generated, and thus, cold generated from the evaporator 140 may be effectively transmitted to the thermal storage device 170 as well as the inside of the inner case 180. On the other hand, if the compressor 110 is not operated, cold air is not emitted through the evaporator 140, and thus cold air stored in the thermal storage device 170 may be emitted. In this case, the second damper 188 may be opened to communicate the second chamber 186 and the inside of the inner case 180 with each other. Further, the first air blowing fan 171 may be operated to generate convection between the thermal storage device 170 installed within the second chamber 186 and air of the inside of the inner case 180, thus performing heat exchange therebetween.

However, if a second air blowing fan 172 installed adjacent to the thermal storage device 170 is separately provided, the second air blowing fan 172 may be operated to perform emission of cold air without operation of the first air blowing fan 171. Since the second air blowing fan 172 is installed closer to the thermal storage device 170 than the first air blowing fan 171, the second air blowing fan 172 may be operated to emit cold air stored in the thermal storage device 170.

The modification of the embodiment of FIG. 28 may be used when it is necessary to perform a process of preferentially storing cold air in the thermal storage device 170 rather than lowering of the inner temperature of the refrigerator.

As broadly described and embodied herein, a refrigerator in accordance with the present disclosure may control an electric power consumption rate by distinguishing periods of high electric rates and period of low electric rates, thereby reducing costs associated with electric power.

The refrigerator in accordance with the present disclosure employs a method of cooling a phase change material of a thermal storage device through conduction, and is thus usable when an amount of the phase change material is large and a cold air storage time of the thermal storage device is insufficient as compared to a cold air emission time of the thermal storage device. If cooling of the phase change material is carried out through conduction, heat exchange may be directly performed, and thus, energy for generating cold air may be more effectively stored in the phase change material.

Further, cooling of the thermal storage device through convection may be applied to a situation in which the thermal storage device is not structurally exposed to the inside of the refrigerator or a situation in which there are many drawbacks generated by decrease of the inner volume of the refrigerator due to exposure of the thermal storage device to the inside of the refrigerator.

Cooling of the thermal storage device through conduction may be applied to a situation in which a melting point of the phase change material is low and storage of cold air by indirect cooling through convection is difficult. Further, the refrigerator in accordance with the preset disclosure may include a separate heat exchanger or evaporation unit to transmit cold air of the thermal storage device, thus improving cold air transmission efficiency of the thermal storage device. Particularly, if the evaporation unit is used to transmit cold air from the thermal storage device, it may not be necessary to add a component to expose the thermal storage device to the inside of the refrigerator, and thus, a necessity of design changes be reduced.

In one embodiment, a refrigerator may include a compressor to compress a refrigerant, a condenser to condense the refrigerant passed through the compressor, a capillary tube that lowers a temperature and pressure of the refrigerant passed through the condenser, an evaporator to evaporate the refrigerant passed through the capillary tube, a thermal storage device for auxiliary cooling that undergoes heat exchange with the refrigerant to store thermal energy, an energy management device that receives electric rate information, and a controller configured to control the compressor based on the electric rate information received at the energy management device. The controller may control an operation of the thermal storage device to provide auxiliary cooling when the compressor is not operational.

The refrigerator may further include a second refrigerant that undergoes heat exchange with the thermal storage unit to provide auxiliary cooling, wherein the controller controls a flow of the second refrigerant based on the electric rate information received at the energy management device. The controller may restrict flow of the second refrigerant when the electric rate information is below a prescribed amount. The thermal storage device may be coupled to an outlet of the evaporator. A heat exchanger may be coupled to the thermal storage device by a guide pipe through which the second refrigerant circulates between the thermal storage device and the heat exchanger. A valve may be provided at the guide pipe to control a flow of the second refrigerant, wherein the thermal storage device, the heat exchanger, the guide pipe and the valve forms a thermosyphon through which the second refrigerant flows by convection. An induction pipe may be provided for the second refrigerant to circulate between the thermal storage device and the evaporator. Moreover, a valve may be coupled to an outlet of the condenser and configured to change a flow path of the refrigerant between a first path and a second path, wherein the capillary tube is positioned in the first path, and a second capillary tube and the thermal storage device are positioned in the second path.

A valve may be configured to change a path of the first refrigerant, wherein the controller controls the valve based on electric rate information received from the energy management device. The controller may control the valve to route the first refrigerant to provide auxiliary cooling using the thermal storage device when electric rates are above a first prescribed amount, or to route the first refrigerant to store thermal energy in the thermal storage device when electric rates are below a second prescribed amount.

A second capillary tube may be provided that lowers the temperature and pressure of the refrigerant flowing from the valve. The capillary tube may be coupled to a first outlet of the valve and the second capillary tube is coupled to a second outlet of the valve. The refrigerant having passed through the second capillary tube and the refrigerant having passed through the evaporator may be mixed or controlled to individually flow, and may be guided to the thermal storage device.

The valve may be coupled to an output of the evaporator, a first outlet of the valve coupled to the thermal storage device and a second outlet of the valve coupled to a bypass tube. The bypass tube may be disposed in parallel with the thermal storage device with respect to a circulation direction of the refrigerant.

The valve may be positioned to receive refrigerant from the condenser, and the capillary tube may be coupled to a first outlet of the valve, and a second capillary tube and the thermal storage device may be coupled to a second outlet of the valve. The thermal storage device may be disposed in parallel with the evaporator with respect to a circulation direction of the refrigerant.

In one embodiment, a refrigerator may include a compressor to compress a first refrigerant that flows in a first cooling cycle, a condenser to condense the first refrigerant passed through the compressor, a capillary tube that lowers a temperature and pressure of the first refrigerant passed through the condenser, an evaporator to evaporate the first refrigerant passed through the capillary tube, a thermal storage device for auxiliary cooling that undergoes heat exchange with the refrigerant to store thermal energy, a second refrigerant that undergoes heat exchange with the thermal storage device to cool a refrigeration chamber, an energy management device that receives electric rate information, and a controller configured to control the compressor based on the electric rate information received at the energy management device. The controller may control an operation of the thermal storage device to provide auxiliary cooling when the compressor is not operational, and control a flow of the second refrigerant based on the electric rate information received from the energy management device.

The first and second refrigerants may be different refrigerants that flow in separate cooling cycles. The thermal storage device may be coupled to a thermosyphon that transfers thermal energy from the thermal storage device to the refrigeration chamber to provide the auxiliary cooling, the second refrigerant circulating in the thermosyphon through convection. The controller may operate the thermosyphon when the electric rate information is above a prescribed level.

In one embodiment, a refrigerator may include a compressor to compress a refrigerant, a condenser to condense the refrigerant passed through the compressor, a capillary tube that lowers the temperature and pressure of the refrigerant passed through the condenser, an evaporator to evaporate the refrigerant passed through the capillary tube, a thermal storage device for auxiliary cooling that undergoes heat exchange with the refrigerant to store thermal energy, a valve configured to change a flow path of the refrigerant, an energy management device that receives electric rate information, and a controller configured to control the compressor based on the electric rate information received at the energy management device. In this embodiment, the controller may control an operation of the thermal storage device to provide auxiliary cooling when the compressor is not operational, and controls the valve based on the electric rate information received at the energy management device.

In one embodiment, a refrigerator includes a compressor compressing a first refrigerant, a condenser condensing the first refrigerant having passed through the compressor, a capillary tube lowering the temperature and pressure of the first refrigerant having passed through the condenser, an evaporation unit evaporating the first refrigerant having passed through the capillary tube, a thermal storage device cooled by heat exchange with the first refrigerant circulating along a refrigerating cycle through conduction, an energy management device performing an electric charge saving mode to save electric charges based on electric power information supplied from the outside, and a refrigerator controller controlling the compressor according to electric power information transmitted from the energy management device, wherein the electric power information is information regarding electric power supply time at which electric charges are varied.

The refrigerator may further include a second refrigerant cooling the inside of the refrigerator using cold air stored in the thermal storage device, and the refrigerator controller may control the second refrigerant according to the electric power information transmitted from the energy management device.

The refrigerator controller may prevent restriction of movement of the second refrigerant when electric charges are relatively low. The thermal storage device may be disposed at the rear end of the evaporation unit. The refrigerator may further include a heat exchanger connected to the thermal storage device by a guide pipe and performing circulation of the second refrigerant with the thermal storage device. A switching valve adjusting circulation of the second refrigerant by a thermosyphon may be provided in the guide pipe. An induction pipe along which the second refrigerant moves to be circulated may be provided between the thermal storage device and the evaporation unit.

The refrigerator may further include a first direction change valve branching the refrigerant having passed through the condenser and a sub-capillary tube installed at the rear of the first direction change valve, and the thermal storage device may be disposed at the rear end of the sub-capillary tube.

The refrigerator may further include a path guide unit changing the path of the first refrigerant, and the refrigerator controller may control the path guide unit according to the electric power information transmitted from the energy management device. The refrigerator controller may adjust the path guide unit so as to perform cooling of the inside of the refrigerator or storage of cold air in the thermal storage device when electric charges are relatively low.

The path guide unit may include a first direction change valve branching the refrigerant in front of the capillary tube, and the refrigerator may further include a sub-capillary tube lowering the temperature and pressure of the refrigerant branched by the first direction change valve. The refrigerant having passed through the sub-capillary tube and the refrigerant having passed through the evaporation unit may be mixed or individually flow, and be then guided to the thermal storage device.

The path guide unit may include a second direction change valve branching the refrigerant at the rear of the evaporation unit, and the refrigerator may further include a bypass tube guiding the refrigerant branched by the second direction change valve. The bypass tube may be disposed in parallel with the thermal storage device based on the direction of the refrigerating cycle.

The path guide unit may include a first direction change valve branching the refrigerant having passed through the condenser, the refrigerator may further include a sub-capillary tube installed at the rear of the first direction change valve, and the thermal storage device may be disposed at the rear end of the sub-capillary tube. The thermal storage device may be disposed in parallel with the evaporation unit based on the direction of the refrigerating cycle.

In another aspect of the present disclosure, a control method of a refrigerator includes judging whether or not an electric charge saving mode of the refrigerator is selected and stopping operation of a compressor and cooling the inside of the refrigerator using cold air stored in a thermal storage device when electric charges are relatively high, upon judging that the electric charge saving mode is selected. In the cooling of the inside of the refrigerator, transmission of cold air may be performed by a second refrigerant differing from a first refrigerant circulated by the compressor.

General operation in which the compressor is operated to supply cold air to the inside of the refrigerator or to store cold air in the thermal storage device may be performed, when electric charges are relatively low. In the general operation, supply of cold air to the inside of the refrigerator and storage of cold air in the thermal storage device may be selectively carried out.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a compressor to compress a refrigerant;

a condenser to condense the refrigerant passed through the compressor;

a capillary tube that lowers a temperature and pressure of the refrigerant passed through the condenser;

an evaporator to evaporate the refrigerant passed through the capillary tube;

a thermal storage device for auxiliary cooling that undergoes heat exchange with the refrigerant to store thermal energy;

an energy management device that receives electric rate information; and a controller configured to control the compressor based on the electric rate information received at the energy management device, wherein the controller controls the thermal storage device to store thermal energy and the compressor to operate when the electric rate information is below a prescribed amount, such that a refrigerating chamber and a freezing chamber become cool by cooling of the compressor, wherein the controller controls the thermal storage device to provide auxiliary cooling and the compressor not to operate when a temperature of the refrigerating chamber and the freezing chamber becomes higher than a specific temperature and the electric rate information is above or equal to the prescribed amount, such that the refrigerating chamber and the freezing chamber become cool by cooling of the thermal storage device, wherein the compressor cools the refrigerating chamber and the freezing chamber while the thermal storage device does not cool the refrigerating chamber and the freezing chamber, and wherein the thermal storage device cools the refrigerating chamber and the freezing chamber while the compressor does not cool the refrigerating chamber and the freezing chamber.

2. The refrigerator of claim 1, further comprising a second refrigerant that undergoes heat exchange with the thermal storage unit to provide auxiliary cooling, wherein the controller controls a flow of the second refrigerant based on the electric rate information received at the energy management device.

3. The refrigerator of claim 2, wherein the controller restricts flow of the second refrigerant when the electric rate information is below the prescribed amount.

4. The refrigerator of claim 2, wherein the thermal storage device is coupled to an outlet of the evaporator.

5. The refrigerator of claim 4, further comprising a heat exchanger coupled to the thermal storage device by a guide pipe through which the second refrigerant circulates between the thermal storage device and the heat exchanger.

6. The refrigerator of claim 5, further comprising a valve provided at the guide pipe to control a flow of the second refrigerant, wherein the thermal storage device, the heat exchanger, the guide pipe and the valve forms a thermosyphon through which the second refrigerant flows by convection.

7. The refrigerator of claim 4, wherein an induction pipe is provided for the second refrigerant to circulate between the thermal storage device and the evaporator.

8. The refrigerator of claim 2, further comprising a valve coupled to an outlet of the condenser and configured to change a flow path of the refrigerant between a first path and a second path, wherein the capillary tube is positioned in the first path, and a second capillary tube and the thermal storage device are positioned in the second path.

9. The refrigerator of claim 1, further comprising a valve configured to change a path of the first refrigerant, wherein the controller controls the valve based on electric rate information received from the energy management device.

10. The refrigerator of claim 9, wherein the controller controls the valve to route the first refrigerant to provide auxiliary cooling using the thermal storage device when electric rates are above a first prescribed amount, or to route the first refrigerant to store thermal energy in the thermal storage device when electric rates are below a second prescribed amount.

11. The refrigerator of claim 9, further comprising a second capillary tube that lowers the temperature and pressure of the refrigerant flowing from the valve, wherein the capillary tube is coupled to a first outlet of the valve and the second capillary tube is coupled to a second outlet of the valve.

12. The refrigerator of claim 11, wherein the refrigerant having passed through the second capillary tube and the refrigerant having passed through the evaporator are mixed or controlled to individually flow, and guided to the thermal storage device.

13. The refrigerator of claim 10, wherein the valve is coupled to an output of the evaporator, a first outlet of the valve coupled to the thermal storage device and a second outlet of the valve coupled to a bypass tube.

14. The refrigerator of claim 13, wherein the bypass tube is disposed in parallel with the thermal storage device with respect to a circulation direction of the refrigerant.

15. The refrigerator of claim 9, wherein the valve is positioned to receive refrigerant from the condenser, and the capillary tube is coupled to a first outlet of the valve, and a second capillary tube and the thermal storage device are coupled to a second outlet of the valve.

16. The refrigerator of claim 15, wherein the thermal storage device is disposed in parallel with the evaporator with respect to a circulation direction of the refrigerant.

* * * * *